US005535719A

United States Patent [19]

Morikawa et al.

[11] Patent Number: 5,535,719

[45] Date of Patent: Jul. 16, 1996

[54] PURGE-COMPENSATED AIR-FUEL RATIO CONTROL APPARATUS

[75] Inventors: Junya Morikawa, Kasugai; Kazuto Maeda, Aichi-gun; Nobuhiko Koyama, Nagoya; Hiroshi Tamura, Kariya, all of Japan

[73] Assignee: Nippondenso Co., Ltd., Kariya, Japan

[21] Appl. No.: 313,836

[22] Filed: Sep. 28, 1994

[30] Foreign Application Priority Data

Oct. 15, 1993 [JP] Japan ..... 5-258482
Nov. 17, 1993 [JP] Japan ..... 5-288198

[51] Int. Cl.[6] ..... F02D 41/04; F02M 3/06; F02M 25/08

[52] U.S. Cl. ..... 123/339.17; 123/339.18; 123/698; 123/520

[58] Field of Search ..... 123/339.14, 339.16, 123/339.17, 339.18, 698, 478, 519, 520

[56] References Cited

U.S. PATENT DOCUMENTS 5,216,995 6/1993 Hosoda et al. ..... 123/520
5,228,421 7/1993 Orzel ..... 123/520
5,299,544 4/1994 Kitamoto et al. ..... 123/520
5,329,909 7/1994 Hosoda et al. ..... 123/520
5,363,832 11/1994 Suzumura et al. ..... 123/520

FOREIGN PATENT DOCUMENTS 1323180 10/1993 Canada .
6101517 4/1994 Japan .

*Primary Examiner*—Willis R. Wolfe
*Attorney, Agent, or Firm*—Cushman, Darby & Cushman

[57] ABSTRACT

A canister is provided between a fuel tank and an intake conduit of an engine so that fuel vapor generated in the tank and adsorbed in the canister is purged into the intake conduit. In correcting a fuel quantity in accordance with a purge quantity, the fuel quantity is compensated for by a canister piping condition such as a pressure loss and/or a purge delay. A first fuel correction coefficient is calculated from canister pressure, intake pressure and atmospheric pressure. The first coefficient may be calculated in association with an idling speed control value. A second fuel correction coefficient is calculated from changes in purge flow quantity and canister pressure. The second coefficient may be calculated in association with an air-fuel ratio feedback control value.

12 Claims, 19 Drawing Sheets

FULL OPEN PURGE RATE MAP (%)

| NE \ PM | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(mmHg)

(rPm)

START
S300
FIRST ON OF IG SWITCH ?
YES
NO
S301
XIPGR = 1 ?
YES
NO
S302
ACCELERATION OR DECELERATION ?
YES
NO
S303
XNFGPG = 1 ?
NO
YES
S304
PGR > γ % ?
NO
YES
S305
1-FAFAV > ω %?
NO
YES
S308
FGPG = FGPG+ (FAFAV − 1)/PGR
S309
XNFGPG = 1 ?
YES
NO
S310
STABILIZED ?
NO
YES
S311
XNFGPG = 1
S312
FGPGAV
S315
FGPG = 1.0
S316
FGPGAV = 1.0
S317
XNFGPG = 0
END

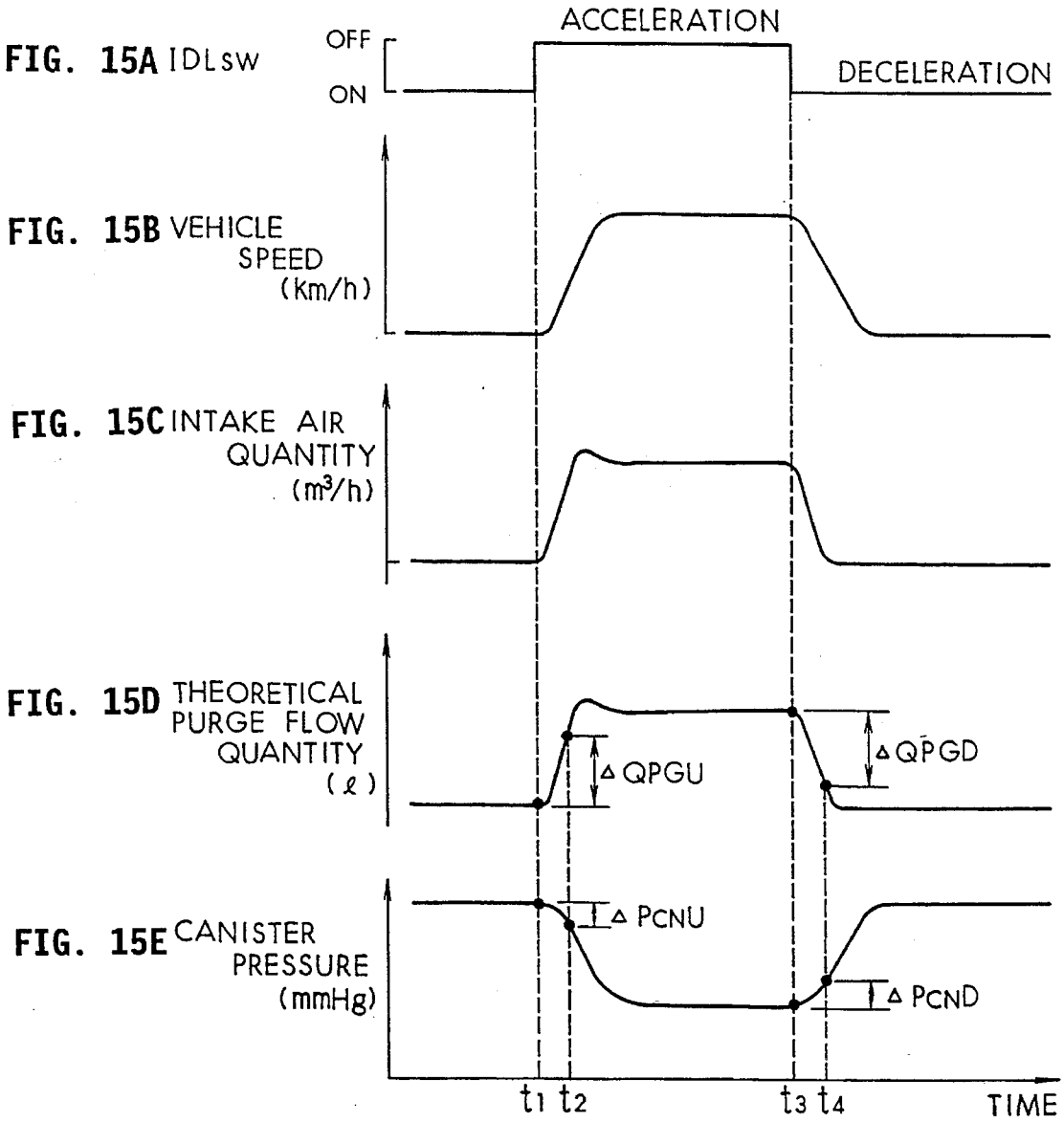
ACCELERATION
FIG. 15A IDLsw
OFF
ON
DECELERATION
FIG. 15B VEHICLE SPEED (Km/h)
FIG. 15C INTAKE AIR QUANTITY (m³/h)
FIG. 15D THEORETICAL PURGE FLOW QUANTITY (ℓ)
ΔQPGU
ΔQPGD
FIG. 15E CANISTER PRESSURE (mmHg)
ΔPCNU
ΔPCND
t1 t2
t3 t4
TIME

PURGE-COMPENSATED AIR-FUEL RATIO CONTROL APPARATUS

BACKGROUND OF THE INVENTION

1. Field of the Invention

The present invention relates to a fuel control apparatus for an internal combustion engine provided with a fuel vaporized gas diffusion prevention device for preventing diffusion of fuel vaporized gas generated in a fuel supply system of a motor vehicle.

2. Related Art

Until recently, vaporized fuel generated in a fuel tank has been adsorbed by active carbon, which is then purged into an adsorption system. For instance, Japanese Laid-Open Patent Publication No. 289243/1988 discloses performing correction of a fuel injection quantity in addition to performing air-fuel ratio feedback correction in response to an air-fuel ratio of a mixture when the purging is attained. The purge correction quantity is set according to the concentration of vaporized fuel obtained from the average value of the feedback correction coefficient, thereby improving control of the air-fuel ratio.

However, because actual purge quantity varies in dependence on piping conditions of the purge system, the air-fuel ratio control is degraded. For instance, pressure loss is caused in the piping of the purge system. This will result in a decrease of the actual purge quantity from a theoretical purge quantity. Further, an intake conduit and a canister are not disposed next to one another. Instead, they are located apart from each other. Thus, the actual purge quantity is delayed due to pressure loss in a supply conduit or the like. A purge quantity is not increased proportionally after purging starts, but the purge quantity is gradually increased instead. This causes a delay in the actual purge quantity. Accordingly, control of an air-fuel ratio in transition worsens and both emissions and the drivability of the vehicle are influenced. Furthermore, recently, the mounting of a large canister on a rear portion of a vehicle in order to minimize generation of vaporized fuel has been proposed. However vehicles including such a structure have been found to have an adverse effect on the air-fuel ratio.

SUMMARY OF THE INVENTION

An object of the present invention is to provide a fuel control apparatus for an internal combustion engine in which control of the air-fuel ratio in the engine is maintained without being affected by purge piping conditions such as pressure loss in a purge piping and a canister and/or a delay in the actual purge quantity.

Accordingly, the present invention provides a fuel injection quantity control apparatus for an internal combustion engine including a canister having an adsorber for adsorbing fuel vapor generated in a fuel tank, which contains liquid fuel. Also, the invention includes means for detecting purge piping conditions, such as pressure loss and/or delay in the purge flow quantity caused when the fuel vaporized gas is purged from the canister. Furthermore, the invention includes means for correcting the fuel injection quantity based on the result detected by the purge quantity delay detection means.

In the present invention, the canister is provided with an adsorber for adsorbing fuel vapor generated in the fuel tank, which contains liquid fuel. The purge flow quantity delay detection means detects pressure loss in the purge system and/or delay in purge flow quantity caused when fuel vapor is purged from the canister. The fuel injection quantity correction means corrects the fuel injection quantity based on the result detected by the detection means.

BRIEF DESCRIPTION OF THE DRAWINGS

These and other objects, features, and characteristics of the present invention will become apparent to a person of ordinary skill in the art from a study of the present application, including the detailed description, claims, and drawings, all of which form a part of this application. In the drawings:

FIGS. 15A–15E are waveforms in a time chart indicating changes of a vehicle speed, an intake air quantity, a theoretical purge flow quantity and canister pressure when the vehicle is accelerated or decelerated;

DETAILED DESCRIPTION OF THE PRESENTLY PREFERRED EXEMPLARY EMBODIMENTS

Hereinafter, embodiments of the present invention will be described with reference to the attached drawings.

Figure 1:
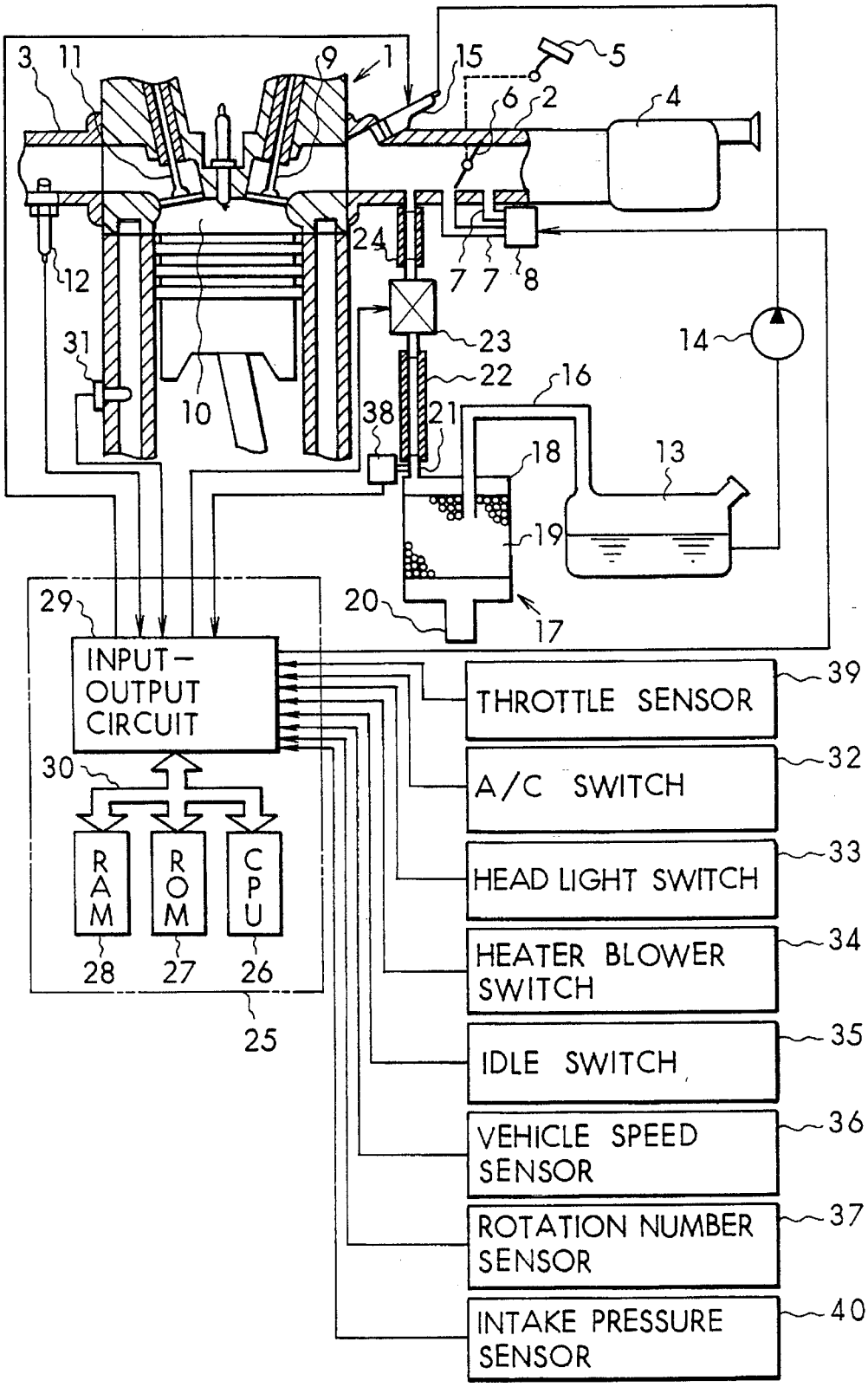
FIG. 1 is a schematic view illustrating construction of an embodiment of the present invention.

FIG. 1 illustrates construction of engine 1 and interrelated pieces that are connected to the engine and mounted on a motor vehicle, such as an automobile. Intake conduit 2 and exhaust conduit 3 are connected to engine 1. Air cleaner 4 for filtering air is disposed at the upstream end of intake conduit 2. Thus, air is drawn through air cleaner 4 into intake conduit 2. Throttle valve 6 is disposed in intake conduit 2 and linked with accelerator pedal 5, which acts to open and close throttle valve 6. Bypass passage 7 is disposed so as to bypass throttle valve 6, and rotation number control valve 8 is disposed on an intermediate portion of bypass passage 7. Opening degree adjustment is given by the duty control of rotation number control valve 8, and thus the quantity of intake air when engine 1 is idling may be adjusted to enable change in the number of rotations of engine 1.

Air from intake conduit 2 is supplied into combustion chamber 10 through intake valve 9. Exhaust gas in combustion chamber 10 is exhausted into exhaust conduit 3 via exhaust valve 11. Oxygen ($O_2$) sensor 12 is disposed in exhaust conduit 3.

Fuel pump 14 is connected to fuel tank 13, which stores liquid fuel. Thus, fuel in fuel tank 13 is conveyed under pressure by fuel pump 14. The fuel from fuel pump 14 is supplied into fuel injection valve 15 mounted on intake conduit 2, and fuel is injected by the opening and closing of fuel injection valve 15. Fuel tank 13 is connected to a canister 17 by communication conduit 16. Canister body 18 includes an adsorber 19 for adsorbing fuel vapor. For example, the adsorber may be active carbon. Thus, fuel vapor generated in fuel tank 13 is adsorbed into adsorber 19 of canister 17 via communication conduit 16. Atmospheric opening 20 is formed on canister body 18 to open canister 18 to atmosphere and to enable air to be drawn into the interior of canister 18.

Figures 2, 3:
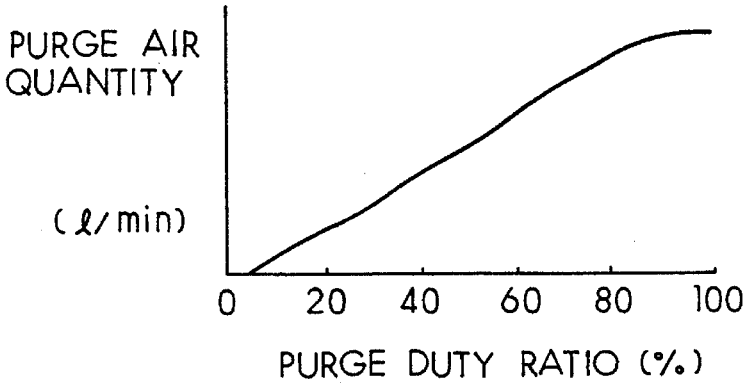
FIG. 2 is a graph illustrating a characteristic of a purge solenoid valve.
FIG. 3 indicates a full open purge rate map when the purge solenoid valve is fully opened.

Furthermore, hose connecting portion 21 is formed on canister body 18. Canister pressure sensor 38 is connected to hose connecting portion 21. Also, one end of supply conduit 22 is connected with hose connecting portion 21. The other end of supply conduit 22 is connected to purge control valve 23. Supply conduit 24 is connected at one end thereof to purge control valve 23 while being connected to intake conduit 2 at the other end thereof. Accordingly, purge control valve 23 is disposed between both supply conduits 22, 24 so that intake conduit 2 and canister 17 communicate via supply conduit 22, purge control valve 23, and supply conduit 24. Thus, this structure allows for fuel vapor adsorbed in adsorber 19 to be introduced in intake conduit 2 when negative pressure is generated in intake conduit 2. The degree to which purge control valve 23 opens is adjustable based on the duty control. Purge flow quantity passing through both supply conduits 22, 24 is changed in accordance with the opening degree. FIG. 2 is a characteristic view of a purge quantity at this time and indicates the relationship between the purge duty ratio of purge control valve 23 and a purge quantity in the case where negative pressure in intake conduit 2 is constant. From this figure, it is understood that a purge quantity, namely a quantity of air drawn into engine 1 through canister 17, is increased substantially in linearly, as the duty of the purge control valve 23 is increased from 0%. Supply conduits 22, 24 are formed with flexible material, such as a rubber hose, a nylon hose or the like.

Electronic control circuit 25 includes CPU 26, ROM 27, RAM 28 and input-output circuit 29, which are interconnected through common bus 30. In ROM 27, a program for control of CPU 26 and data are stored previously, and RAM 28 is conditioned in readable/writable states. Input-output circuit 29 inputs various signals to CPU 26. Input-output circuit 29 receives an input signal from $O_2$ sensor 12, a signal from canister pressure sensor 38, a signal from water temperature sensor 31 for detecting temperature of engine cooling water, a signal from throttle sensor 39 for detecting an opening degree of the throttle valve 6, a signal from air conditioner switch 32 for detecting on/off actions of an air conditioner for a motor vehicle, a signal from a head light switch 33 for detecting the lighting action of a head light, a signal from a heater blower switch 34, a signal from an idle switch 35, which is activated when accelerator pedal 5 is released, a signal from vehicle speed sensor 36, a signal from rotation sensor 37 and a signal from intake pressure sensor 40.

FIG. 3 illustrates a full open purge rate map determined based upon the engine rotation number Ne and load PM (at this time, the load may be replaced by intake conduit pressure, an intake air flow quantity or a throttle opening degree). This map indicates the ratio of a quantity of air flowing through supply conduit 24 at the duty 100% of the purge control valve 23 against all the quantity of air flowing into the engine 1 through the intake conduit 2. This map is stored in the ROM 27.

CPU 26 controls the driving of fuel injection valve 15, purge control valve 23, and rotation number control valve 8 through the input-output circuit 29 on a basis of these signals and the program or data and the like in ROM 27 and RAM 28.

In the end, CPU 26 adjusts an opening degree of purge control valve 23 in accordance with the operating condition of engine 1 to control the purge flow quantities in supply conduits 22, 24. That is, an opening degree of the purge control valve is calculated and controlled by CPU 26 such that a purge flow quantity becomes a predetermined rate to an intake air quantity detected by an air flow sensor (illustration of it is abbreviated). CPU 26 adjusts an opening degree of the rotation number control valve 8 such that a rotation number of the engine becomes a target rotation number during idling operation of engine 1, controls an intake air quantity, and further controls at a constant the air-fuel ratio of an air-fuel mixture which is supplied into engine 1 and detected by $O_2$ sensor 12. Namely, CPU 26 obtains a basic injection time on the basis of engine rotation detected by rotation number sensor 37 and an intake air quantity detected by air flow sensor (not illustrated), and corrects the basic injection time depending upon a feedback correction coefficient FAF and the like to obtain a final injection time, thereby performing fuel injection via fuel injection valve 15 at a predetermined injection timing.

Feedback control of the air-fuel ratio will be explained with reference to FIG. 4. This processing is performed every predetermined time.

Figure 5:
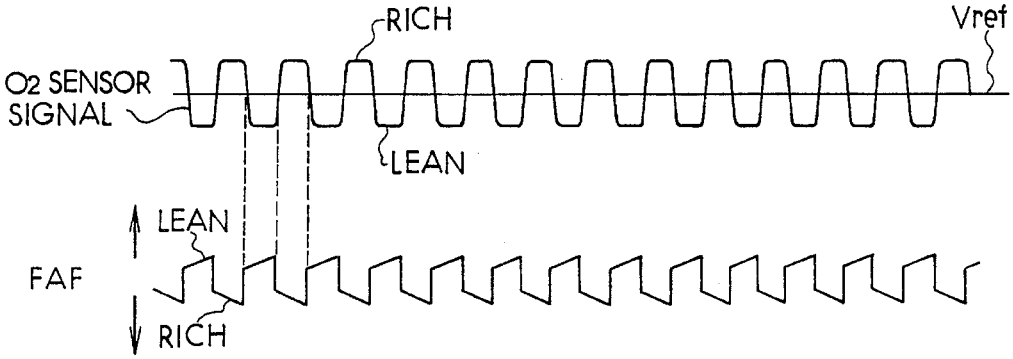
FIG. 5 is a time chart indicating change of a feedback correction coefficient.

As shown in FIG. 5, CPU 26 compares an output voltage of the $O_2$ sensor 12 with comparison voltage Vref to determine whether the air-fuel mixture is rich or lean. Then, CPU 26 determines at step S100 whether or not a condition for feedback control has been satisfied. For instance, the condition is satisfied when the engine cooling temperature detected by cooling water temperature 31 is more than or equal to 40° C. and a throttle opening degree detected by throttle sensor 39 is less than or equal to 70°. If the condition is not satisfied, CPU 26 sets feedback correction coefficient FAF to 1.0 at step S101 so that no feedback control is performed, before proceeding to step S109.

When the feedback condition is satisfied, then CPU 26 determines at step S102 based on a signal from the $O_2$ sensor 12 whether an air-fuel ratio is rich. In case the air-fuel ratio is rich, CPU 26 compares it with the preceding detected result at step S103 to determine whether the air-fuel ratio has been inverted from lean to rich. When the air-fuel ratio has been inverted from lean to rich, CPU 26 sets a feedback correction coefficient FAF-α (α indicates a skip amount or a proportional control amount) into a new feedback correction coefficient FAF at a step S104. When the air-fuel ratio is not inverted from lean to rich, CPU 26 sets a feedback correction coefficient FAF-β (β indicates an integral amount or an integral control amount, and α>β) into a new feedback correction coefficient FAF at a step S105. The processing then proceeds to step S109.

At step S109 an average value FAFAV of the calculated feedback correction coefficient FAF is obtained by the following equation (1).

$$FAFAV=(63\times FAFAV_{(-1)}+FAF)/64 \quad (1)$$

where $FAFAV_{(-1)}$ is a value of FAFAV previously calculated.

In case the air-fuel ratio is lean at step S102, CPU 26 compares the present value with the preceding detected result at step S106 to determine whether the air-fuel ratio has been inverted from rich to lean. When the air-fuel ratio has been inverted from rich to lean, CPU 26 sets feedback correction coefficient FAF+α (α is a skip amount) into new feedback correction coefficient FAF at step S107. When the air-fuel ratio is not inverted from rich to lean, CPU 26 sets feedback correction coefficient FAF+β (β is an integral amount) into new feedback correction coefficient FAF at step S108. Then, the program proceeds to step S109 wherein the previously described processing is performed.

When the air-fuel ratio is inverted between rich and lean by means of processing in the steps S102–S108, feedback correction coefficient FAF is changed in a stepwise manner (skipped) so as to increase or decrease the fuel injection quantity. When the air-fuel ratio is rich or lean, feedback correction coefficient FAF is gradually increased or decreased.

Figure 6:
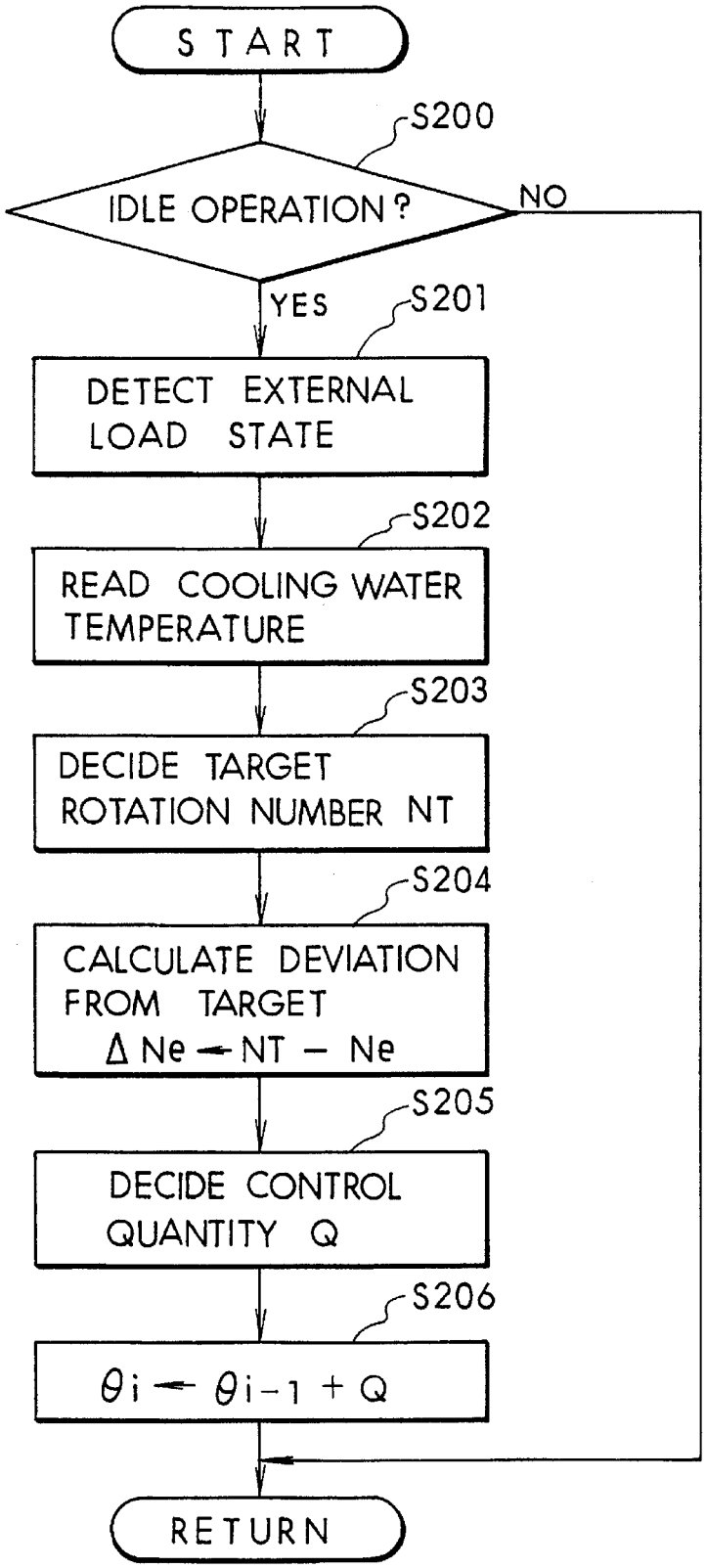
FIG. 6 is a flowchart indicating target idle rotation number processing to be executed by the CPU.

FIG. 6 illustrates a target idle rotation number control processing routine which is executed at predetermined intervals.

Figure 7:
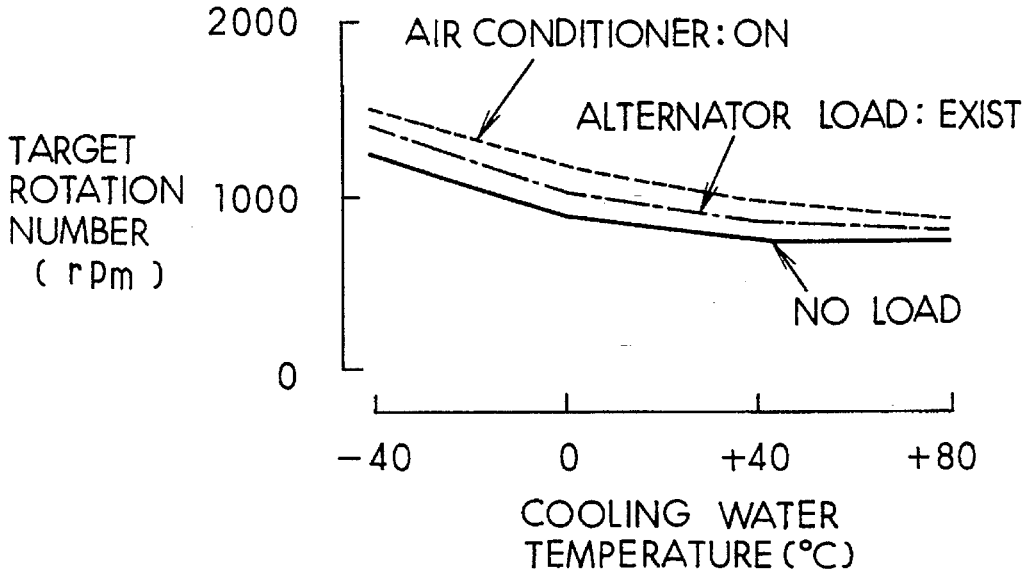
FIG. 7 is a graph illustrating a target rotation number versus cooling water temperature.

CPU 26 determines at step S200 whether engine 1 is experiencing an idling operation. It is determined that the engine is at an idling state when idle switch 35 is turned on and a vehicle speed detected by vehicle speed sensor 36 is less than or equal to 2 (Km/h). When the engine is in the idling state, then CPU 26 senses at step S201 the manipulated state of air conditioner switch 32 and a load state of an alternator (manipulated states of head light switch 33 and heater blower switch 34) and reads thereinto engine cooling temperature detected by the water temperature sensor 31 at step S202. CPU 26 determines a target rotation number NT at step S203. This means that the target rotation number NT is determined on a basis of a load state (with no load, with alternator load and with the air conditioner turned on) that occurs at engine cooling water temperatures by using the graph of FIG. 7.

Figure 8:
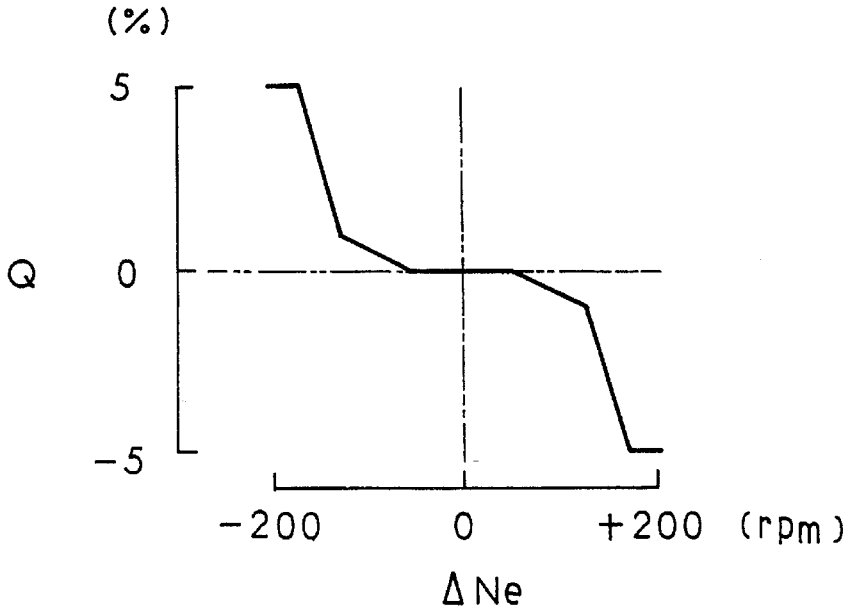
FIG. 8 indicates a map for obtaining an opening degree of a rotation number control valve.

Next, CPU 26 calculates at step S204 a deviation ΔNe (=NT−Ne) between the target rotation number NT and the actual engine rotation number Ne detected by the rotation number sensor 37. A control degree opening Q of the rotation number control valve 8 is calculated in step S205. This calculation of the control opening quantity Q means to obtain a control opening quantity corresponding to the deviation ΔNe of a rotation number by using the graph illustrated in FIG. 8. Furthermore, a value obtained by adding the control opening degree Q to the preceding opening degree $\theta_{i-1}$ of rotation number control valve 8 is set by CPU 26 into the following opening degree $\theta_i$ of rotation number control valve 8 at step S206, and rotation number control valve 8 is controlled in duty by CPU 26 such that it become the opening degree $\theta_i$ in its opening degree.

Figure 9:
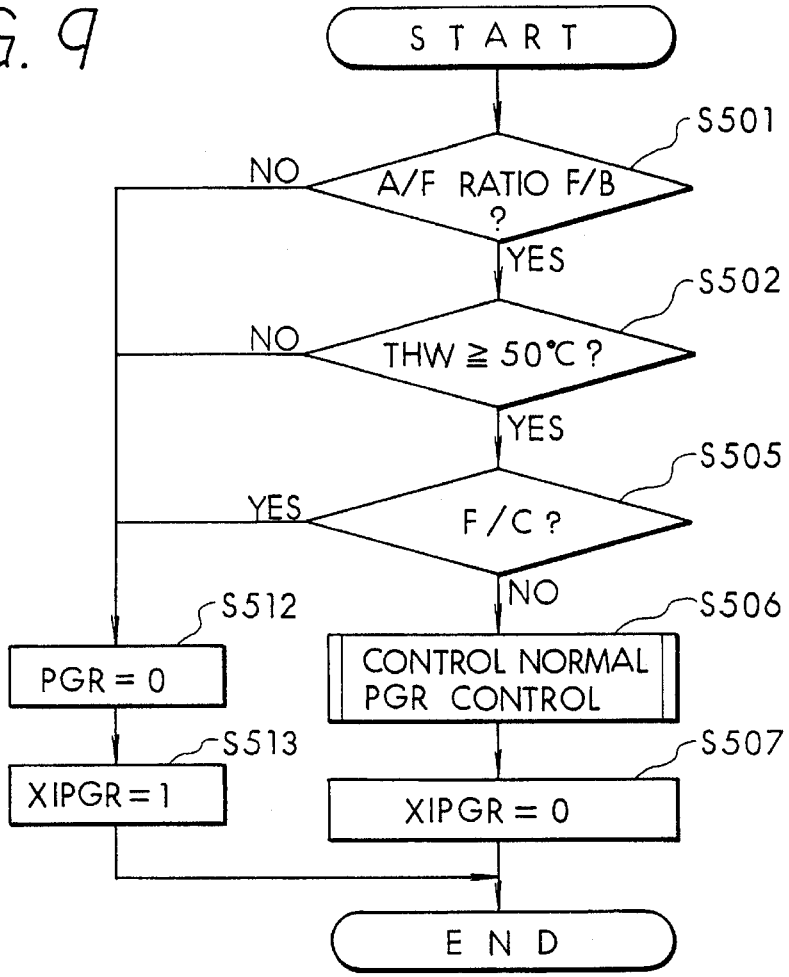
FIG. 9 is a flowchart of purge execution control processing to be performed by the CPU.

FIG. 9 illustrates a main routine for execution and control of purge. This routine is also executed under a base routine of CPU 26 at predetermined intervals (about every 4 ms).

At step S501, it is determined whether the engine is operative during the air-fuel ratio feedback control by determining whether conditions in which cooling water temperature, except at the start timing of the engine, is greater than or equal to 40° C. are satisfied. Then, step S502 determines whether the cooling water temperature is greater than or equal to 50° C. At step S505, it is determined whether the engine is under fuel-cut condition, when water temperature is greater than or equal to a predetermined temperature 50° C. during air-fuel ratio feedback control. When it is determined that the engine is not under fuel-cut condition, the program proceeds to step S506 wherein normal purge rate control is performed. Thereafter, for execution of purge rate control, a flag XIPGR indicating that the purge is not yet executed is set to 0 at step S507. In addition, when a purge rate condition is not satisfied at steps S501, S502 and S505, the program proceeds to step S512 wherein the purge rate is set to 0 to disable purging. Thereafter, the program proceeds to step S513 wherein the flag XIPGR is set to 1 indicating no purging.

Figure 10:
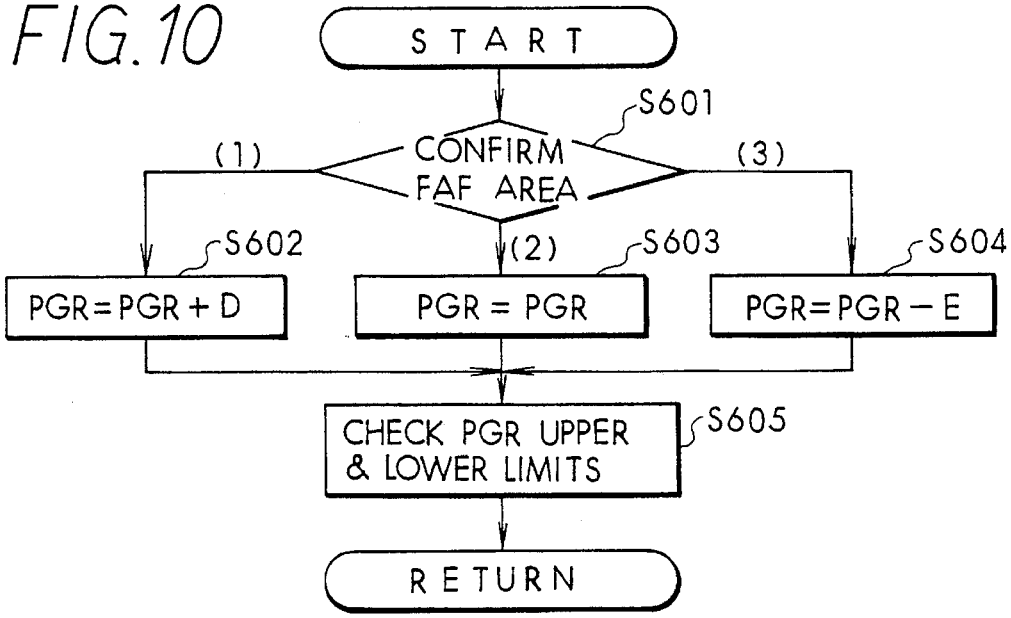
FIG. 10 is a flowchart of normal PGR control processing to be executed by the CPU.
Figure 11A:
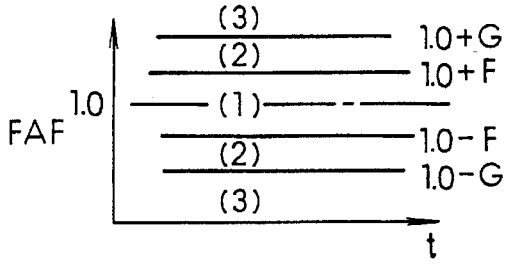
FIGS. 11A through 11E are various characteristic views used for the normal PGR control processing.

FIG. 10 illustrates a normal purge rate control subroutine at step S506 of FIG. 9. First, at step S601, it is detected whether or not an FAF value (or an FAF averaged value) exists in either one of three areas (1), (2) and (3) and has a reference value 1.0. Here, as shown in FIG. 11A, the area (1) indicates that the FAF value is within 1.0±F %, the area (2) indicates that the FAF is further apart than 1.0±F % and is within ±G % (where F<G), and the area (3) indicates that the FAF is greater than or equal to 1.0±G %.

Figure 11B:
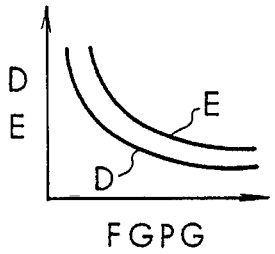
Figure 11C:
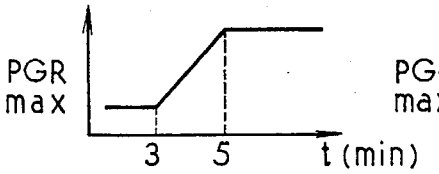
Figure 11D:
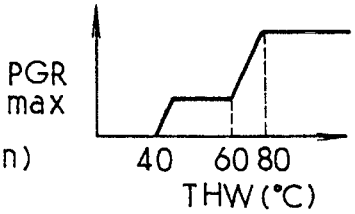
Figure 11E:
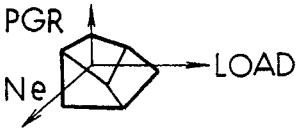

When the area 1 is detected, the program proceeds to step S602 wherein the purge rate (PGR) is increased by a predetermined value D %. When the area 2 is detected, the program proceeds to step S603 wherein PGR is maintained as it is. When the area (3) is detected, the program proceeds to step S604 wherein PGR is decreased by a predetermined value E %. It is preferable to change the predetermined values D and E in accordance with evaporator concentration (FGPG) as shown in FIG. 11B. Then, at step S605, a check regarding the upper and lower limits of PGR is performed. Here, the upper limit value is the smallest value of various conditions such as a purge start time shown in FIG. 11C, water temperature shown in FIG. 11D, an operating condition (a full open purge rate map) shown in FIG. 11E and the like.

Figure 12:
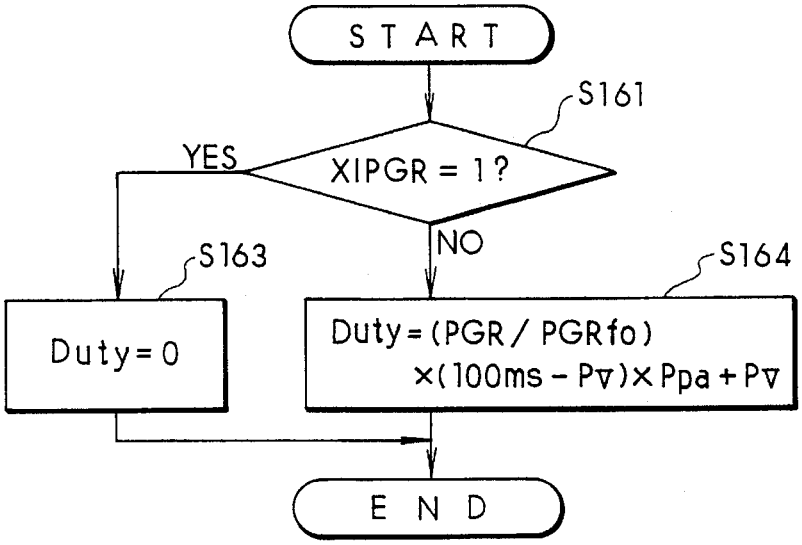
FIG. 12 is a flowchart indicating a purge solenoid valve control processing to be executed by the CPU.

FIG. 12 indicates a purge control valve control routine which is executed by CPU 26 with time interrupt every 100 ms. When flag XIPGR indicating that the purge is not yet executed is 1 at step S161, the program proceeds to step S163 wherein duty of the purge control valve 23 is set to 0. When XIPGR is not 1 in step S161, the program proceeds to a step S164. Assuming that a driving period of time of purge control valve 23 is 100 ms, the duty of the purge control valve 23 is obtained by the following equation (2).

$$\text{Duty}=(PGR/PGRfo)\times(100\text{ ms}-Pv)\times Ppa+Pv \quad (2)$$

Here, PGR is the purge rate obtained in FIG. 10, PGRfo is a purge rate at each operating condition when purge control valve 23 is fully opened (refer to FIG. 3), Pv is a voltage correction value against fluctuation of battery voltage, and Ppa is an atmospheric pressure correction value against fluctuation of atmospheric pressure.

Figure 13:
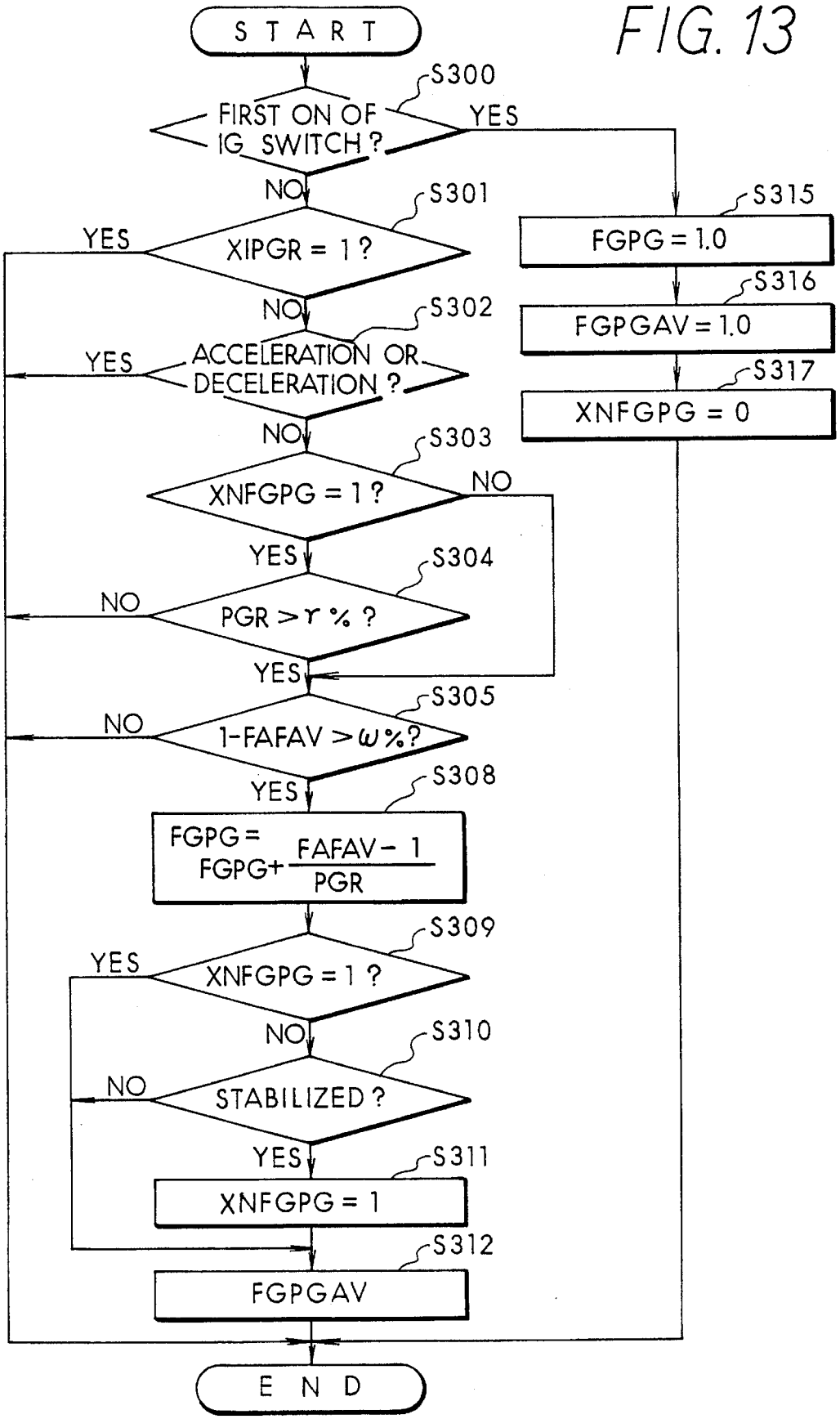
FIG. 13 is a flowchart showing evaporator concentration detection processing to be executed by the CPU.

Next, FIG. 13 indicates a main routine of evaporator concentration detection, i.e., evaporated gas concentration detection which is executed under the base routine of CPU 26 at predetermined intervals (about 4 ms). First, when a key switch or ignition switch is turned on at step S300, the program proceeds to steps S315, S316 and S317. Evaporator concentration FGPG and evaporator concentration average value FGPGAV are initially set to 1.0 and first time concentration detection flag XNFGPG is initially set to 0. If the ignition switch has been already turned on when the program reaches step S300, the program proceeds to step S302 when the purge control has been started and flag XIPGR is not 1 indicating that the purge has not yet executed. In case flag XIPGR is 1 and the purge control is not yet started, the concentration detection ends. At step S302, whether or not the vehicle is subject to acceleration or deceleration is determined. Here, the determination as to whether the vehicle is being accelerated or decelerated may be performed by a generally well known method by detecting the idle switch, change of a throttle opening degree, change of intake conduit pressure, a vehicle speed and the like.

When it is determined that the vehicle is being accelerated or decelerated at step S302, the program ends. When no acceleration or deceleration is determined, the program proceeds to step S303 wherein the routine determines whether first time concentration detection end flag XNFGPG is 1. When first time concentration detection end flag XNFGPG is 1, the program proceeds to step S304. When first time concentration detection end flag XNFGPG is not 1, the program bypasses step S304 and proceeds to step S305. When the first time concentration detection ends, step 304 determines whether a purge rate is greater than or equal to a predetermined value (γ%). When the purge rate is not greater than or equal to the predetermined value, the program ends. When the purge rate is greater than or equal to the predetermined value, the program proceeds to step S305.

Figure 4:
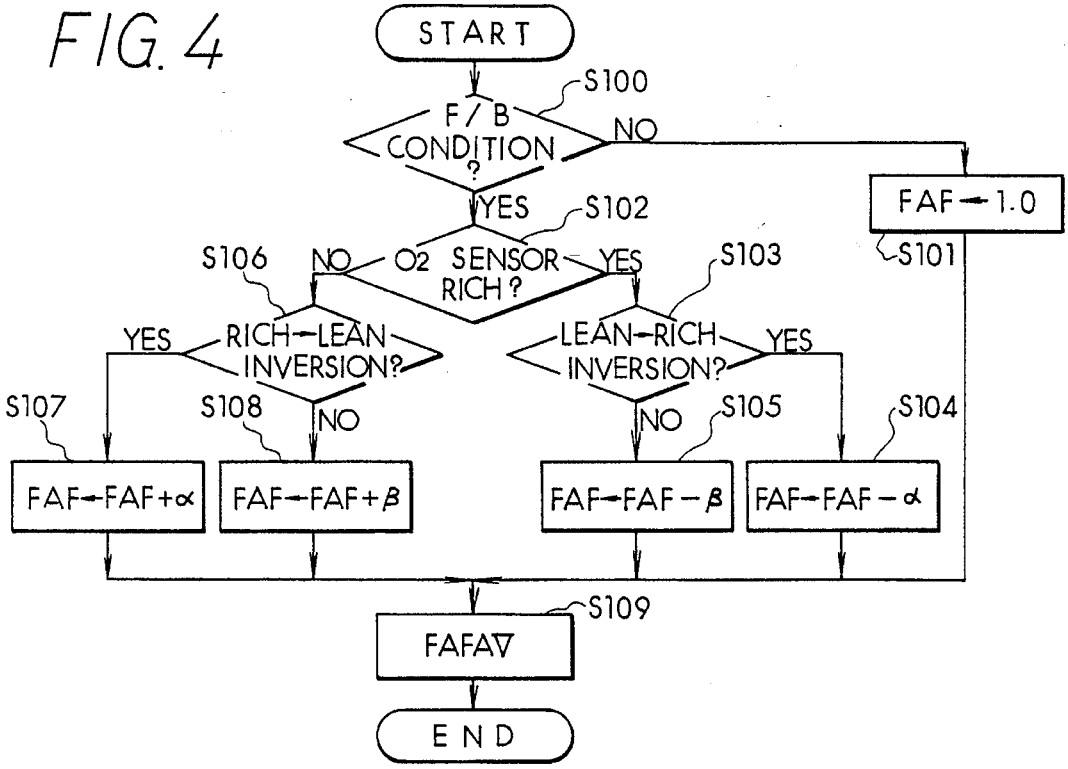
FIG. 4 is a flowchart of air-fuel ratio feedback control processing to be executed by a CPU.

At step S305, it is determined whether or not the deviation from the reference value 1 of FAFAV obtained at the step S109 of FIG. 4 is greater than or equal to a predetermined value (ω%). When the deviation is not greater than or equal to the predetermined value, the program ends. When the deviation is greater than or equal to the predetermined value, the program proceeds to step S308 wherein evaporator concentration is detected. At step S308, a new value for evaporator concentration FGPG is calculated by adding the preceding value of evaporator concentration FGPG to the quotient of the deviation from the reference value 1 of FAFAV divided by PGR. Accordingly, when the evaporator concentration in supply conduit 24 is 0, i.e., 100% air, the value of evaporator concentration FGPG becomes 1. As the evaporator concentration in supply conduit 24 becomes more dense, the set value of evaporator concentration FGPG becomes smaller than 1. Here, when FAFAV is replaced by at step S308 of FIG. 13, the evaporator concentration may be obtained in such a manner that as the evaporator concentration becomes more dense the set value of FGPG becomes larger than 1.

Step S309 determines whether first time concentration detection end flag XNFGPG is 1. When first time concentration detection end flag XNFGPG is not 1, the program proceeds to step S310. When the first time concentration detection end flag XNFGPG is 1, the program bypasses steps S310 and S311 and proceeds to step S312. At step S310, it is determined whether or not the evaporator concentration has been stabilized by comparing the change between two successive detection values of evaporator concentration FGPG with a predetermined value θ % and determining whether the change is within the predetermined value for three successive cycles. When the evaporator concentration has been stabilized, the program proceeds to step S311 where first time concentration detection end flag XNFGPG is set to 1. Thereafter, the program proceeds to step S312. When step S310 determines that the evaporator concentration is not stabilized at step S310, the processing proceeds to step S312. For averaging at step S312, the first time evaporator concentration FGPG is operated with predetermined averaging (for instance 1/64 averaging) and the processing obtains an evaporator concentration average value FGPGAV.

Next, operating processing of a first purge flow quantity correction coefficient which is a characteristic part of the present invention will be described.

Figure 14A:
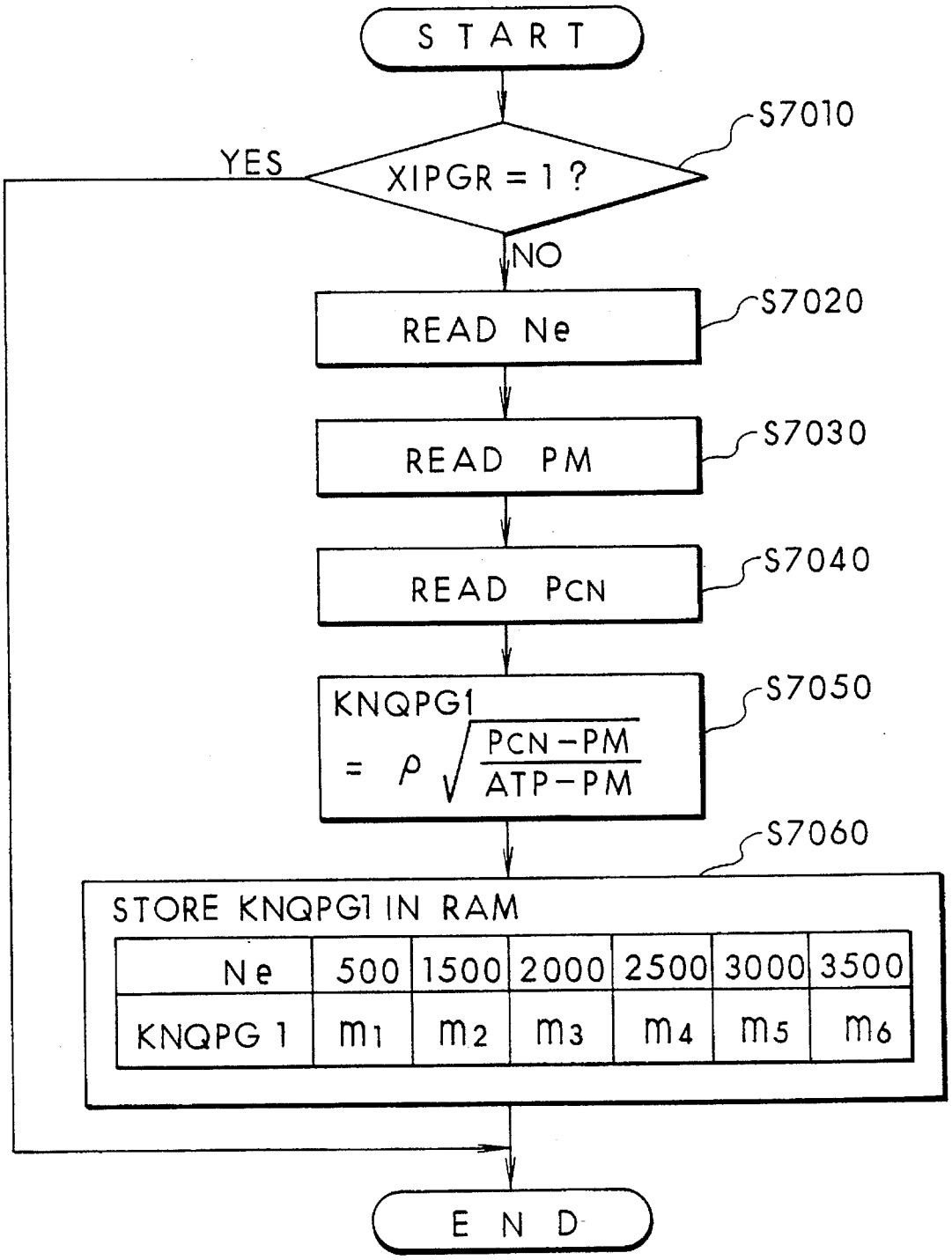
FIGS. 14A and 14B are flowcharts indicating purge flow quantity correction coefficient detection processing to be executed by the CPU.

FIG. 14A is the flowchart of the processing which uses canister pressure sensor 38 for the first purge flow quantity correction coefficient. Description will be made hereinunder with reference to this flowchart. Here, it is to be understood that the pressure difference is detected in place of the flow quantity difference in this embodiment.

When this processing is performed, it is determined at step S7010 whether purge non-execution flag XIPGR is 1 or not. If it is 1, the processing ends. If it is 0, engine rotation number Ne is read from the output of rotation number sensor 37 at following step S7020. Next, intake pressure PM is read from the output of the intake conduit pressure sensor 40 at step 703 and a difference from the atmospheric pressure ATM is calculated. Further, at step S7040, pressure $P_{CN}$ between canister 17 and purge control valve 23 is read from canister pressure sensor 38 and a difference from intake pressure PM read at step S7030 is calculated. At step S7050, first purge flow quantity correction coefficient KNQPG1 is calculated based on the following equation at step S7050.

$$KNQPG1=\rho\{(P_{CN}-PM)/(ATP-PM)\}^{1/2}$$

Here, ρ indicates a coefficient which takes into account a disturbance and is set such that the above equation becomes 1 when canister 17 is new. ATP indicates the atmosperic pressure.

That is, because the value of $P_{CN}$ becomes substantially equal to the atmospheric pressure when canister 17 is new, the value of the right hand bracketed term becomes 1 with the assumption of no disturbance. Since the pressure loss becomes large as canister 17 becomes old, the value of PcN becomes small and actual purge flow quantity becomes small.

Finally at step S7060, the calculated value is stored in the RAM 28 as a map of engine rotation numbers Ne.

Further, operating processing of a second purge flow quantity correction coefficient according to the present invention will be described. In the embodiment, the purge flow quantity correction coefficient operation processing using canister pressure sensor 38 will be explained in accordance with the flowchart illustrated in FIG. 14B. In addition, this processing is executed at predetermined intervals until second purge flow quantity correction coefficients at both acceleration timing and deceleration timing after the ignition switch has been turned on are detected once. As initializing processing, an acceleration timing correction coefficient detection flag FU and a deceleration timing correction coefficient detection flag FD are set to 0, respectively.

When the processing is performed, step S713 determines whether the acceleration timing correction detection flag FU and the deceleration timing correction detection flag FD both have the value of 1. In other words, it is determined whether the purge flow quantity correction coefficients at acceleration timing and deceleration timing have been detected once after the processing has been executed. When both the purge flow quantity correction coefficients are detected and both the flags have the value "1", processing ends. When either one of the purge flow quantity correction coefficients is not detected, the program proceeds to step S701.

At step S701, processing determines whether the flag XIPGR, which is an indicator of whether the purge has been executed, is 1. If the flag XIPGR is not 1, the program proceeds to step S702 where it is determined whether the idle switch is turned off. When the idle switch is turned off, the program proceeds to step S703, in which it is detected whether the idle switch has been switched from on to off at this time. In other words, step S703 determines whether the vehicle has undergone acceleration. If the idle switch is not switched over, i.e., the vehicle has not undergone acceleration, processing ends. If the idle switch is switched over, i.e. the vehicle has undergone acceleration, processing proceeds to step S704.

In step S704, a theoretical value $\Delta QPG_{t1,t2}$ representing the change of a purge flow quantity QPG at a predetermined time (t1–t2) is calculated based on the following equation (3).

$$\Delta QPG_{t1,t2}=QA\times PGR \quad (3)$$

Here QA is an intake air flow quantity, and PGR is a purge rate at that time. Next, at step S705, pressure $\Delta P_{CN}$ of the canister portion, which has changed over a predetermined time (t1–t2), is detected. Then, at step S706 the purge flow quantity correction coefficient KNQPGU at acceleration timing is calculated as KNQPG based on the following equation (4).

$$KNQPGU=1-\delta(\Delta P_{CN}^{1/2}/\Delta QPG_{t1,t2}) \quad (4)$$

Here, $\delta$ is a correction coefficient which takes into account disturbance. At step S714, an acceleration timing correction coefficient detection flag FU is set to 1 indicating that the purge flow quantity correction coefficient KNQPGU at acceleration timing has been calculated, and processing proceeds to step S707, where the value obtained in step S706 is stored in RAM 28 as the second purge flow quantity correction coefficient KNQPG2.

When the idle switch is turned on at the step S702, processing proceeds to step S708. Step S708 determines whether the vehicle's speed is greater than or equal to 30 km/h. If the determination in step S708 is NO, processing ends If the determination in step S708 is "YES", processing proceeds to step S709. At step S709, it is determined whether the idle switch has been switched over from off to on at that time. In other words, a determination is made as to whether the vehicle speed has been decreased from a state where its speed was greater than or equal to 30 km/h. If the idle switch is not switched over, i.e., the vehicle has not undergone deceleration, processing ends. If the idle switch has been switched over, i.e., the vehicle has undergone deceleration, processing proceeds to the following step S710.

At step S710, a changing quantity $\Delta QPG_{t3,t4}$ of a theoretical purge flow quantity QPG at a predetermined time (t3–t4) is calculated based on the following equation (5).

$$\Delta QPG_{t3,t4}=QA\times PGR \quad (5)$$

Here, QA is the intake air flow quantity, and PGR is the purge rate at that time. Next, at step S711, pressure $\Delta P_{CN}$ of the canister portion which has changed over a predetermined time is detected. Then, at step S712 a purge flow quantity correction coefficient KNQPGD at acceleration timing is calculated based on the following equation (6).

$$KNQPGD=1-\delta(\Delta P_{CN}^{1/2}/\Delta QPG_{t3,t4}) \quad (6)$$

At step S715, a deceleration timing correction coefficient detection flag FD is set to "1", which indicates that the purge flow quantity correction coefficient KNQPGD at deceleration timing has been detected, and processing proceeds to step S707. At step S707, the value calculated in step S712 is stored in RAM 28 as the second purge flow quantity correction coefficient KNQPG2.

As described above, in the embodiment, delay in the actual purge flow quantity is detected by comparing a theoretical value of purge flow quantity change at acceleration or deceleration timing obtained by the equation (4) or (6), respectively, with a varying quantity of canister pressure, which is actually detected. The reason why change of the canister pressure is detected as the actual value is that the purge flow quantity depends upon canister pressure.

FIGS. 15A–15E are waveforms in a time chart that indicates changes of the idle switch (IDSW), vehicle speed, intake air quantity ($m^3$/h), theoretical purge flow quantity (l), and canister pressure (mmHg) when the vehicle has been subjected to both acceleration and deceleration.

When the fact that the idle switch has been changed from on to off, which indicates acceleration, is detected, the intake air quantity and the vehicle speed rise respectively. A theoretical purge flow quantity should also simultaneously rise. However, the purge flow quantity fails to proportionately increase with the start of generation of pressure loss in the supply conduit or with the start of purge. This delay in the rise in the purge flow quantity induces delay in the lowering of pressure within the canister. The purge quantity actually rises after a slight delay. According to the above-mentioned processing, this delay is detected and any errors caused by the delay are corrected. In addition, during deceleration timing, the purge quantity drops only after a slight delay as compared to decreases in vehicular speed or intake air quantity. However, no errors in the fuel injection quantity occur, as correction is done.

Figure 16A:
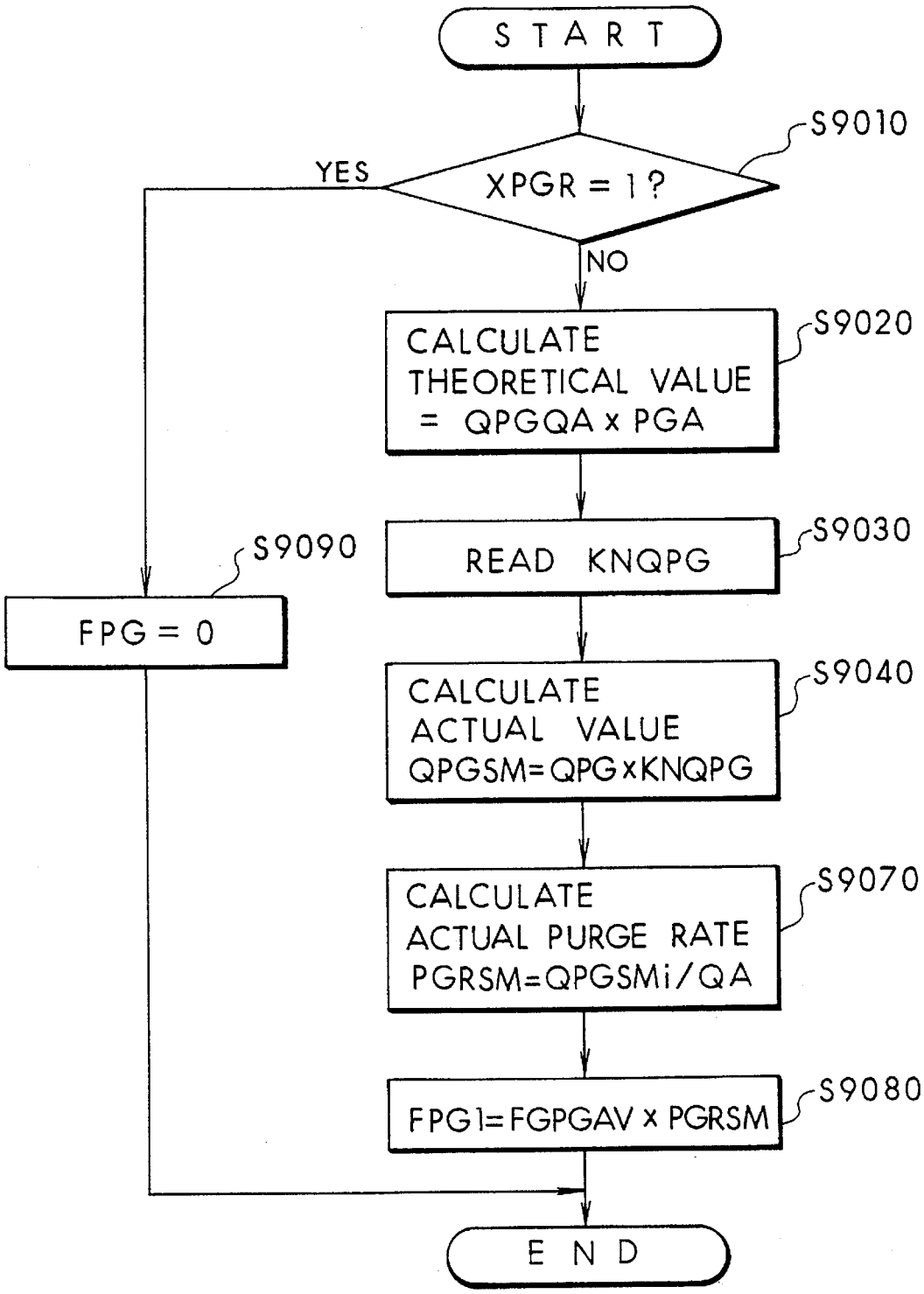
FIGS. 16A and 16B are flowcharts of TAU correction coefficient operation processing to be executed by the CPU.

Next, operating processing routine of a first TAU correction coefficient FPG1 for purge is shown in the flowchart of FIG. 16A and is described hereinunder with reference to this figure.

When processing is performed, step S9010 determines whether the flag XIPGR, which indicates no purging, has been set to 1. If the result is 1, the first TAU correction coefficient FPG1 for purge is reset to 0 at step S909 and processing ends. If the result is 0, a theoretical purge flow quantity QPG is calculated at step S902 based on the following equation.

$$QPG=QA\times PGR$$

At step S9030, purge flow quantity correction coefficient KNQPG1 is read out in accordance with the current engine rotation number Ne. At the following step S9040, actual purge flow quantity QPGSM is calculated from the following equation.

$$QPGSM=QPG\times KNQPG1$$

At step S9070, actual purge rate PGRSM is calculated from the following equation.

$$PGRSM=QPGSM1/QA$$

Finally at step S9080, the first TAU correction coefficient FPG1 for purge is calculated from the following equation.

$$FPG1=FGPGAV\times PGRSM$$

Figure 16B:
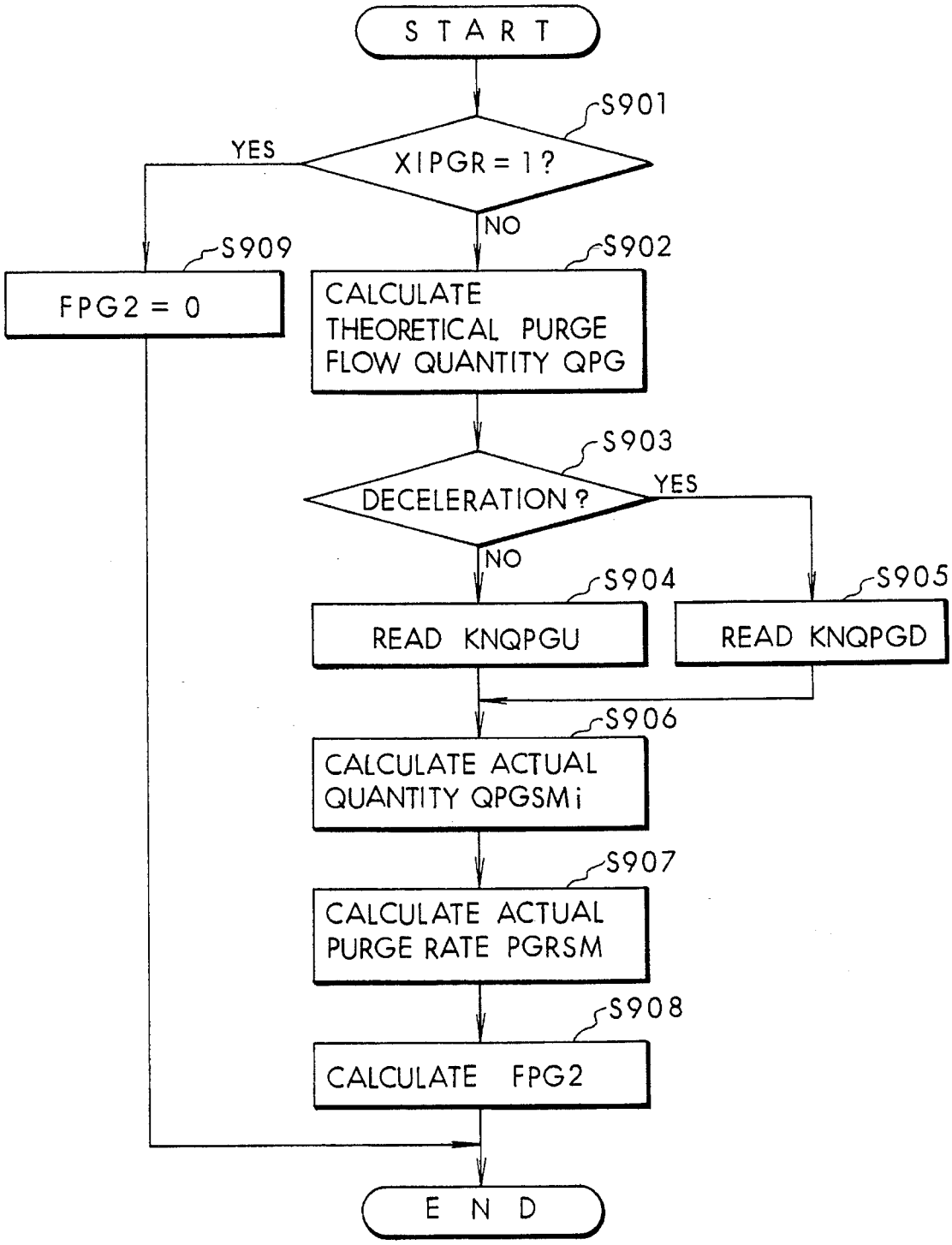

Further, operating processing of a second TAU correction coefficient FPG2 for purge, which is executed at predetermined intervals, is described in accordance with the flowchart of FIG. 16B.

When processing is performed, step S901 determines whether the flag XIPGR, which indicates that the purge is not yet executed, has been set to "1". If the result is "1", the TAU correction coefficient FPG2 for purge is reset to 0 at a step S909 and the processing ends. If the result is not "1", the program proceeds to step S902. At step S902, a theoretical purge flow quantity is calculated on a basis of the following equation (7).

$$QPR=QA\times PGR \quad (7)$$

At step S903, it is determined whether or not the vehicle is in a deceleration state. When the result determined in step S903 is NO the program proceeds to step S904, while the program proceeds to step S905 when the determined result is YES. Purge flow quantity correction coefficient KNQPGU at acceleration timing is read as the second coefficient KNQPG2 at step S904 during steady-state operation or during an acceleration operation and the program proceeds to step S906. Purge flow quantity correction coefficient KNQPGD at deceleration timing is read as the second coefficient KNQPG2 at step S905 during a deceleration operation and the program proceeds to step S906.

At step S906, the actual purge flow quantity $QPGSM_i$ is calculated based on the following equation (8).

$$QPGSM_i=QPGSM_{i-1}\times KNQPG2+(1-KNQPG2)\times QPG \quad (8)$$

Next, step S907 obtains actual purge rate PGRSM using equation (9).

$$PGRSM=QGRSM_i/QA \quad (9)$$

Furthermore, step S908 calculates second TAU correction coefficient FPG2 for purge from the following equation (10).

$$FPG2=FGPGAV\times PGRSM \quad (10)$$

Then, the processing ends.

Figure 17:
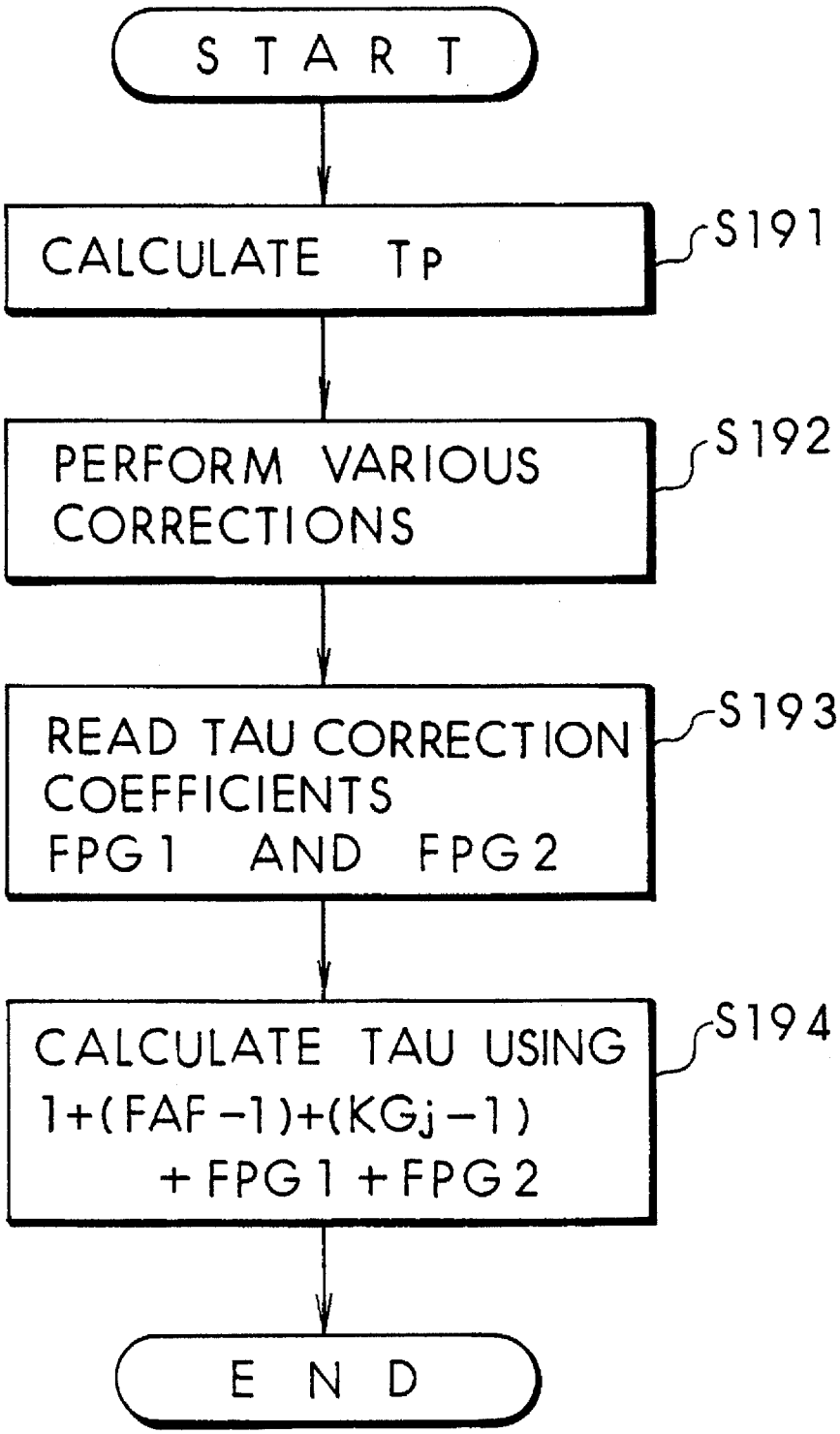
FIG. 17 is a flowchart of fuel injection quantity control processing to be executed by the CPU.

Next, fuel injection quantity control processing, taking into account correction by the two TAU correction coefficients FPG1 and FPG2 for purge, will be explained in accordance with the flowchart shown in FIG. 17. This fuel injection quantity control processing is also executed at predetermined intervals.

When the processing is executed, a basic injection quantity $T_p$ is obtained at step S191 in accordance with engine rotation and load (for instance, intake conduit pressure) based on data stored in ROM 27 as a map. At step S192 various basic corrections, i.e., cooling water temperature correction, correction after start, intake air temperature correction, etc., are performed. At step S193, TAU correction coefficients FPG1 and FPG2 for purge are read, and at step S194, an air-fuel ratio feedback correction coefficient FAF, TAU correction coefficients FPG1 and FPG2 for purge and an air-fuel ratio learning value KGj at every engine operation area are calculated as correction coefficients via operation of the following equation (11) to be used in correcting fuel injection quantity TAU.

$$1+(FAF-1)+(KGj-1)+FPG1+FPG2 \quad (11)$$

Figure 18:
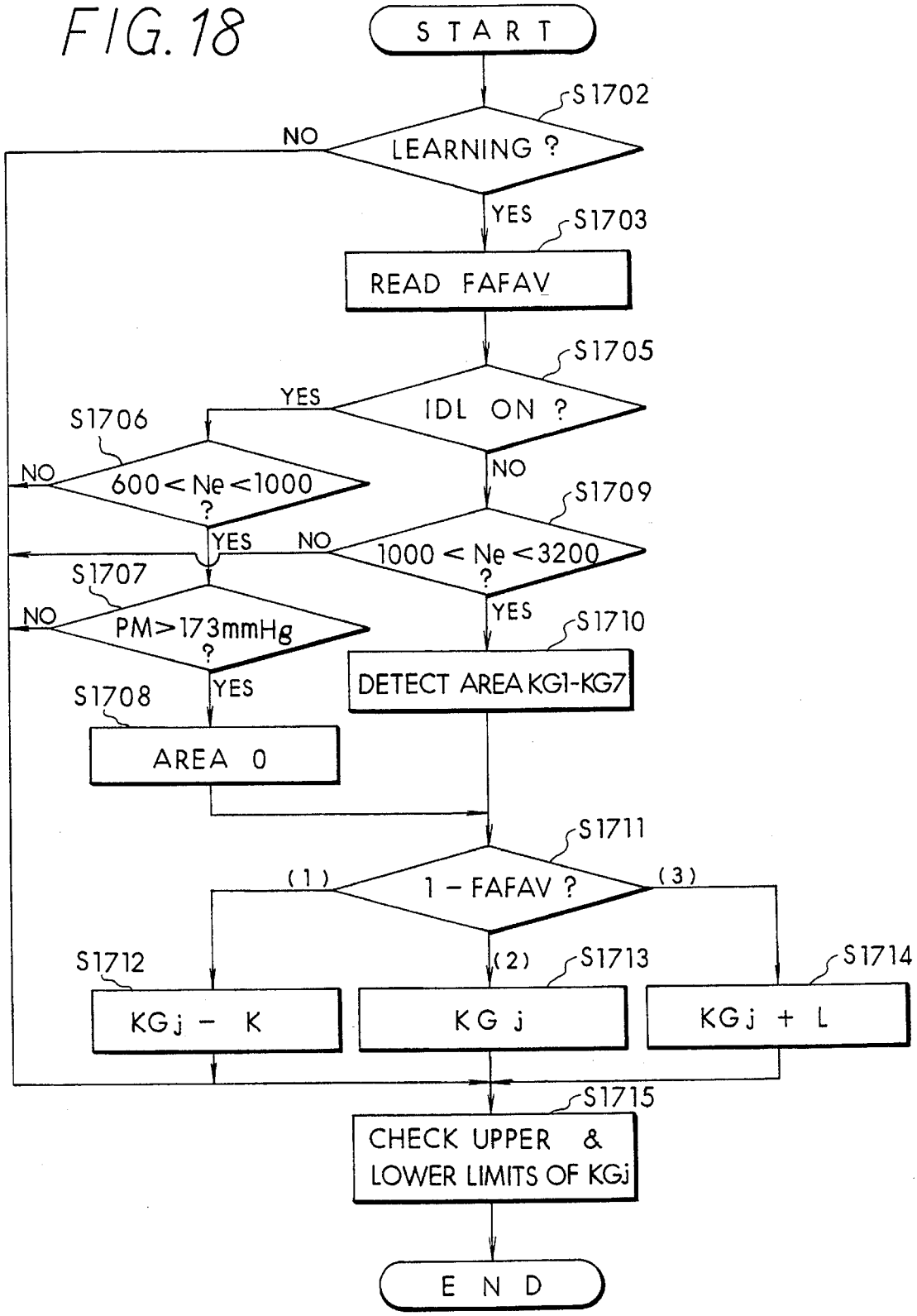
FIG. 18 is a flowchart of air-fuel ratio learning control to be executed by the CPU.

Next, an air-fuel ratio learning control processing which is performed every time the FAF value skips will be explained in accordance with the flowchart shown in FIG. 18.

When the processing is executed by skipping the FAF value, step S1702 determines whether the following learning conditions, are satisfied:

during air-fuel ratio feedback? cooling water temperature THW is greater than or equal to 80° C.?

an increase quantity after start is zero?

warming up increase quantity is zero? FAF value has been skipped at least 5 times after entering the present operating area? and, battery voltage is at least 5.5 V?When at least one learning condition is not satisfied, processing ends. When all the learning conditions are satisfied, the value of FAFAV is read at step S1703. Thereafter, the processing to be performed at idling $KG_0$, via step S1708, and the processing to be performed during travelling, via step S1710, are performed separately based on the result determined in step S1705 as to whether the engine is idling. During travelling, the processing is divided into a predetermined number, e.g., seven, areas, $KG_1$ to $KG_7$, on a basis of load, i.e., for instance pressure in the intake conduit. Only when the engine rotation number is within a predetermined engine rotation number at steps S1706 and S1709, 600<Ne<1000 rpm at idle and 1000<3200 rpm at travelling, the learning value is updated. Furthermore, at idling, the learning value is updated based on a determination in step S1707, when intake conduit pressure PM is at least 173 mmHg.

Updating of the learning values $KG_0$ through $KG_7$ at the respective areas is performed by incrementing or decrementing each of the learning values $KG_0$ through $KG_7$ at its area by a predetermined value (K % or L %) when the difference between FAFAV and a reference value 1.0 is larger than a predetermined value (for instance 2%) (see steps S1711 through S1714). Finally, a check regarding upper and lower limits of KGj is performed at step S1715. Here the upper limit value of KGj is set to be, for instance, 1.2, whereas the lower limit value is set to be 0.8. These upper and lower limit values may be set for every engine operation range. In addition, learning values $KG_0$ through $KG_7$ of the respective areas are stored in RAM 28. These values are supported by an electric source so that they remain in RAM28 even when the power has been turned off by the key switch.

In addition, in the above embodiment, steps S706 and S712 correspond to purge flow quantity delay detection means, and step S194 corresponds to fuel injection quantity correction means.

Figure 14B:
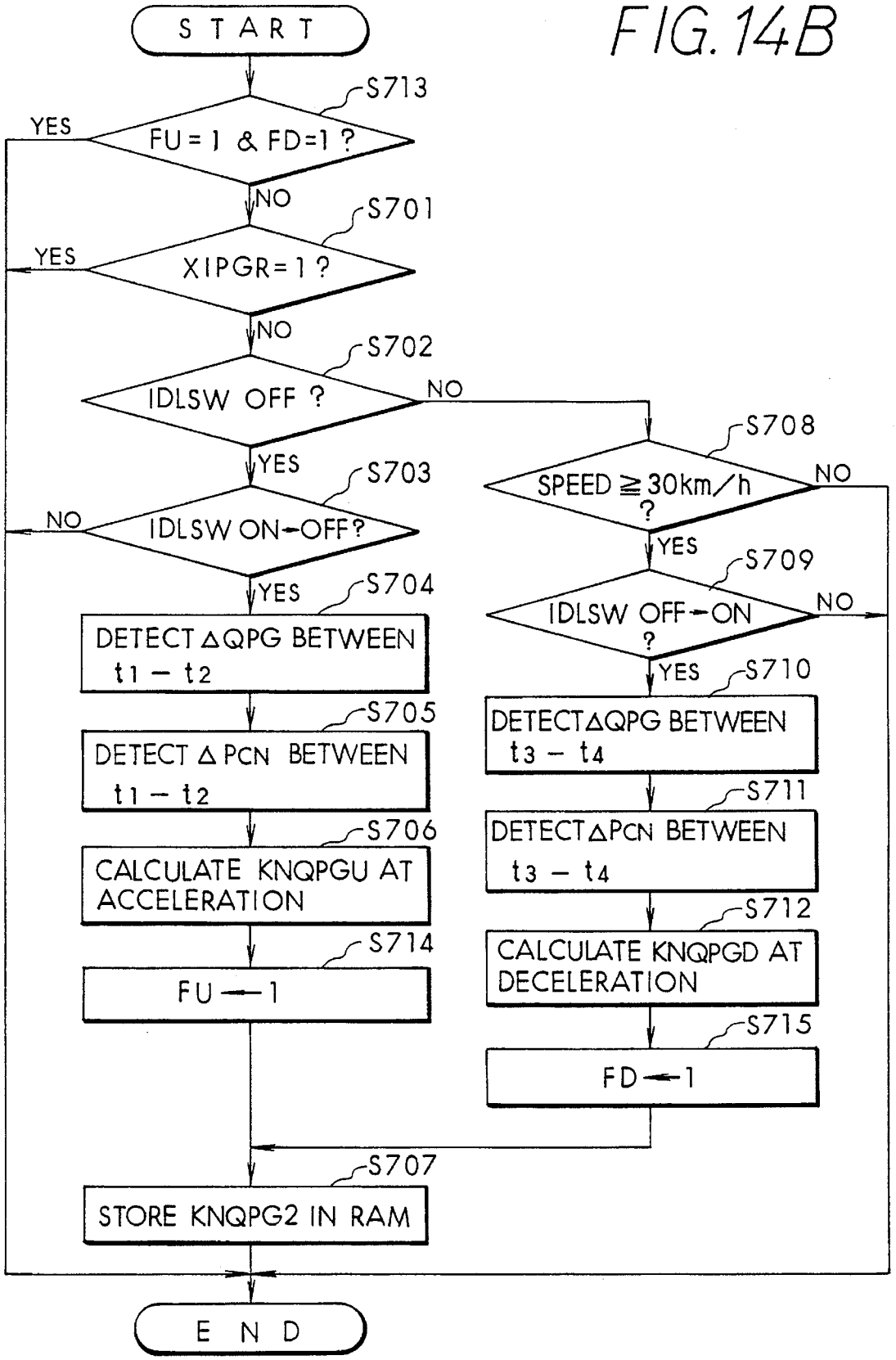

It is to be noted that the detection processing for the purge correction coefficients KNQPG1 and KNQPG2 in FIGS. 14A and 14B may be modified as follows.

Figure 19A:
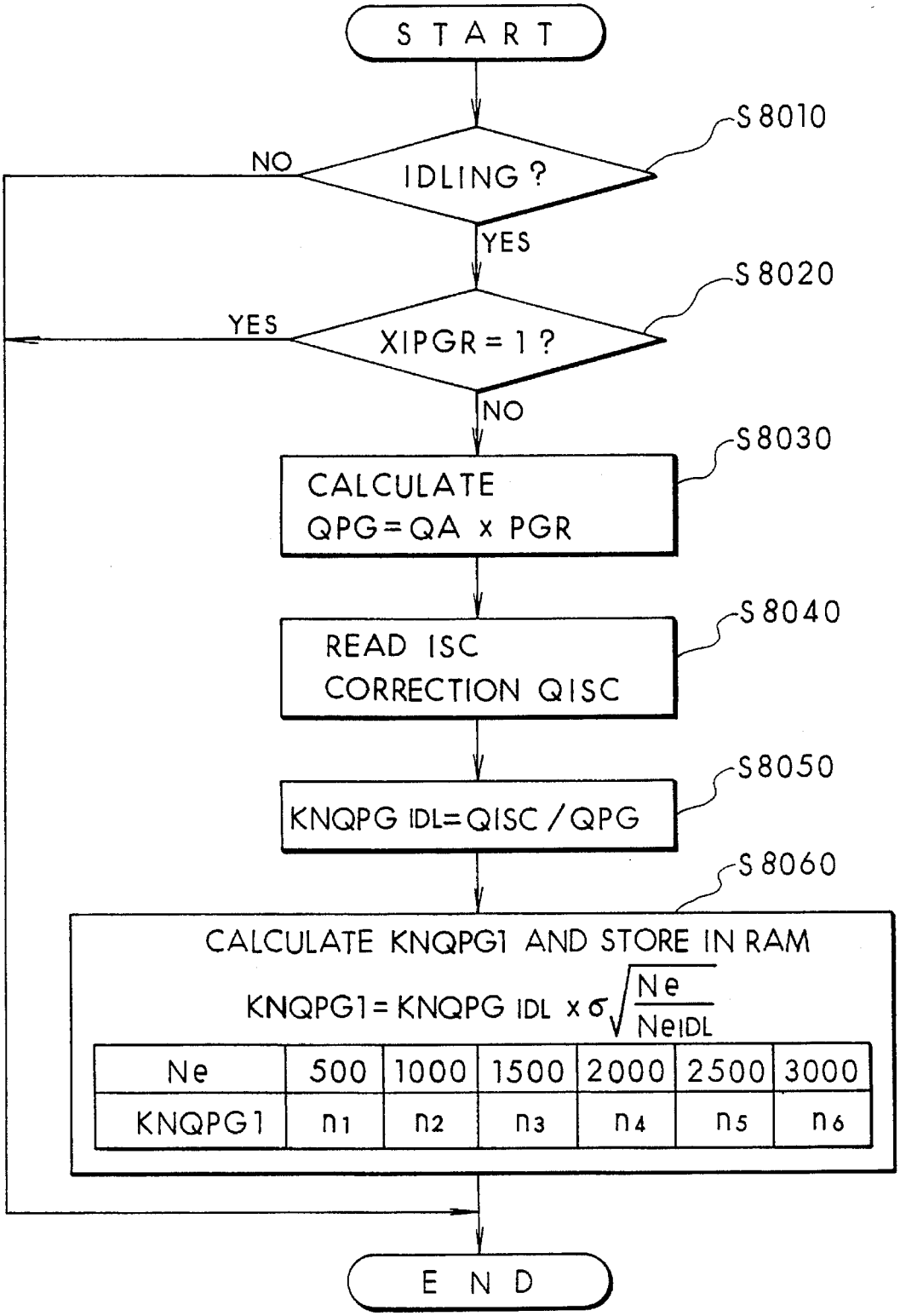
FIGS. 19A and 19B are flowcharts indicating purge flow quantity correction coefficient detection processing to be executed by the CPU of another embodiment.

The processing for calculating the first purge flow quantity correction coefficient by the use of the idle speed control (ISC) will be described with reference to the flowchart of FIG. 19A.

When this processing is started, step S8010 determines whether the engine is under an idling condition or not. The processing ends when the engine is not idling, while processing moves to following step S8020 when the engine is idling. At step S8020, it is determined whether nonpurge execution flag XIPGR is 1 or not. If it is 1, the processing ends. If not 1, on the other hand, the processing moves to step S8030 and calculates the theoretical purge flow quantity QPG from the following equation.

$$QPG=QA\times PGR$$

Here, QA indicates flow quantity with the purge rate being 100%. At next step S8040, ISC correction flow quantity QISC is calculated and, at step 8050, purge flow rate correction coefficient $KNQPG_{IDL}$ at idling is calculated from the following equation.

$$KNQPG_{IDL}=QISC/QPG$$

That is, the above equation value becomes 1 when canister 17 is new, because the theoretical (target) purge flow quantity QPG to be purged becomes equal to ISC correction flow quantity which corrects ISC quantity by the actual purge flow quantity. When canister 17 becomes old, the purge flow quantity actually flowing will become smaller than the calculated theoretical purge flow quantity QPG to be flowed and correction is made by the quantity thus reduced.

Next at step S8060, the first coefficient KNQPG1 which corresponds to engine rotation number Ne is calculated from the following equation, using the idle purge flow quantity correction coefficient $KNQPG_{IDL}$ obtained at step 8050.

$$KNQPG1=KNQPG_{IDL}\times\sigma(Ne/Ne_{IDL})^{1/2}$$

The first correction coefficient KNQPG1 thus obtained is stored in RAM 28 as a one-dimensional map in correspondence to engine rotation number Ne so that the old one is renewed.

Next, operating processing for the second purge flow quantity correction coefficient KNQPG2 by using air-fuel ratio feedback control will be explained in accordance with the flowchart shown in FIG. 19B. The process defined by this flowchart is performed at predetermined intervals until the purge flow quantities at acceleration and deceleration timings are detected after the ignition switch have been turned on. Furthermore, as initializing processing, acceleration timing correction coefficient detection flag FU and deceleration timing correction coefficient detection flag FD are set to 0 when the ignition switch is turned on.

When the processing is executed, step S829 determines whether both acceleration timing correction coefficient detection flag FU and deceleration timing correction coefficient detection flag FD are 1. If both the flags are 1, processing ends due to the determination that the purge flow quantity correction coefficients at acceleration or deceleration timing have been detected at least one time. When both the flags are not "1", non-detection of at least one the purge flow quantities is not detected after the ignition switch is activated. Then, the program proceeds to step S801.

At step S801, a determination is made as to whether the engine is experiencing an idle operation. This determination is made by determining whether the idle switch is turned on and also whether a vehicle speed is equal to 0 km/h. When the determination result is YES, the program proceeds to step S819. When the determination result is NO, the program proceeds to step S802, in which a travelling determination is made, based on whether changes to the vehicle speed is maintained within ±3 km/h. If the determination result is YES, the program proceeds to step S819. If the determination result is NO, processing ends. At step S819, learning control prohibition flag FKG is set to 1 to prohibit air-fuel ratio learning control, and the program proceeds to step S803. At step S803, it is determined whether purge flow quantity correction coefficient detection flag XQPG is 1. If the flag is 1, the program proceeds to step S812. If the flag is not 1, the program proceeds to step S804.

At step S804 purge is halted. At step S805 TAU correction for purge is prohibited. Then, step S806 determines whether an average value FAFAV of feedback correction coefficient FAF is stabilized at a center value 1.0. If the average value is stabilized, the program proceeds to step S807. If the average value is not stabilized, processing returns to step S805, and the same processing is repeated until the value of FAFAV is stabilized at the center value. At step S807, a purge rate in which FAFAV becomes −0.5% (FAFAV=0.95) is calculated based on evaporator concentration detected by the processing of FIG. 13, and purge control is performed.

Figure 20:
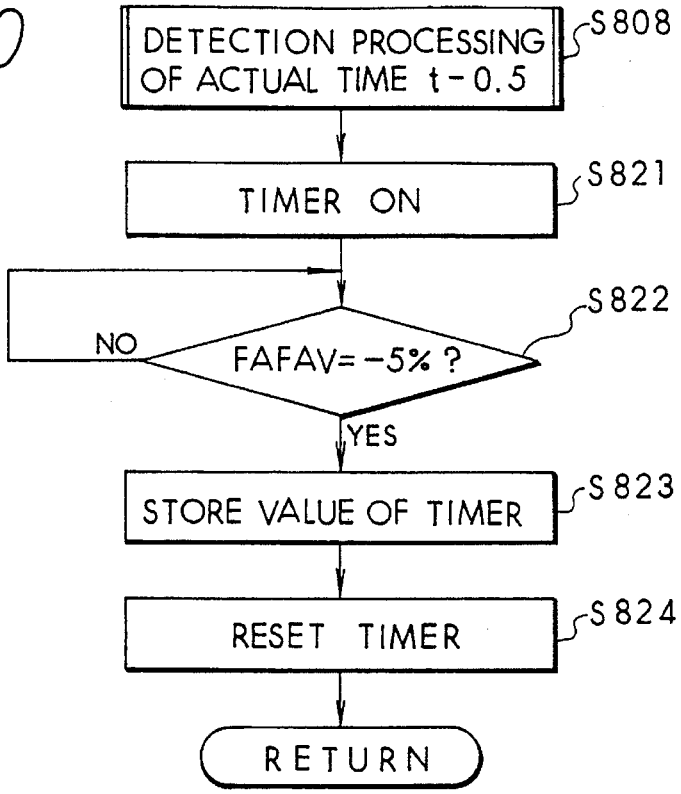
FIG. 20 is a flowchart indicating the actual time $t_{-0.5}$ detection processing to be executed by the CPU.

At step S808, the actual time $t_{-0.5}$ is detected. This time signifies the time taken until FAFAV became −0.5%. FIG. 20 indicates a flowchart illustrating the actual time $t_{-0.5}$ detection processing. Hereinafter explanation will be done in accordance with the flowchart.

First, at step S821, a timer for detecting actual time $t_{-0.5}$ begins. Next, at step S822, the determination is made as to whether FAFAV has become −0.5%. If the determination result is NO, processing is repeated until FAFAV becomes −0.5%. When the determination result becomes YES, the program proceeds to step S823. At step S823 a value of the timer when FAFAV has become −0.5% (FAFAV=0.95) is detected as a value of $t_{-0.5}$ and is stored in RAM 28. Then, at step S824 the timer is reset and the routine ends. Thereafter, the program proceeds to step S809 of FIG. 19B.

At step S809, purge flow quantity coefficient KNQPGU at acceleration timing is calculated by the following equation (12).

$$KNQPGU=1-\eta(t_0/t_{-0.5}) \quad (12)$$

Here, $\eta$ is a correction coefficient when disturbance is considered, and $t_0$ is a theoretical value of time required until FAFAV changes from 1.0 to 0.95 when purged at the purge rate obtained at step S807. At step S810, purge flow quantity correction coefficient detection flag XQPG is set to 1 and the program proceeds to step S830. At step S830, acceleration timing correction coefficient detection flag FU, which indicates that the purge flow quantity correction coefficient KNQPGU at acceleration timing has been detected, is set to 1, and processing continues with step S811. In step S811, purge flow quantity correction coefficient KNQPGU is stored in RAM 28. Then, the routine ends.

When purge flow quantity correction coefficient detection flag XQPG is 1 at step S803, the program proceeds to step S812. At step S812, the purge is carried out at a purge rate in which FAFAV becomes −5% based on the evaporator concentration detected in FIG. 13. At step S813, TAU correction for purge is prohibited. Then, step S814 determines whether a value of FAFAV has become −5%. If the determination result is YES, the program proceeds to step S815. If the determination result is NO, the program returns to the step S813, and the same processing is repeated. At step S815, purge is halted.

Figure 21:
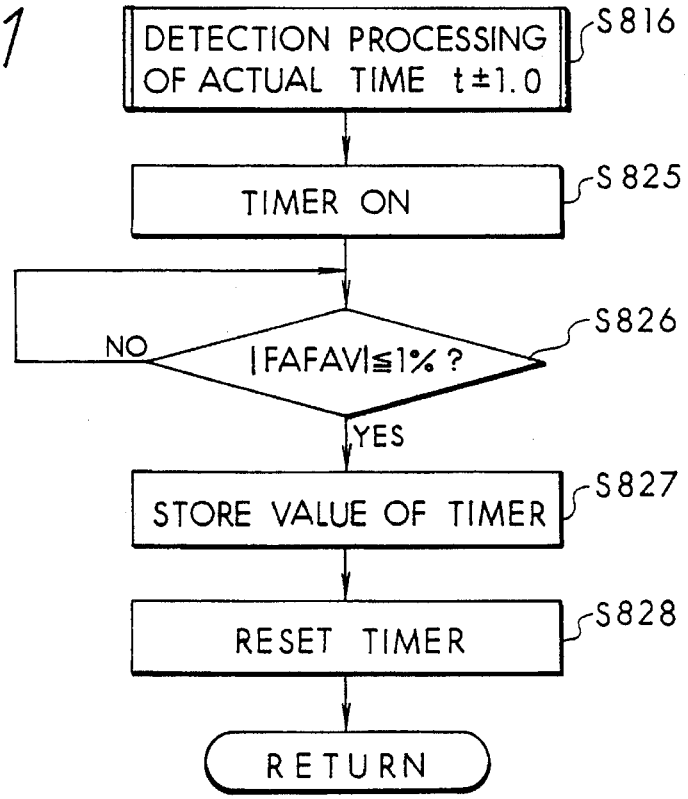
FIG. 21 is a flowchart indicating the actual time $t_{\pm 1.0}$ detection processing to be executed by the CPU.

Then, at step S816, actual time $t_{\pm1.0}$ required until a value of FAFAV returns to a value within ±1.0%. FIG. 21 is a flowchart illustrating detection processing of $t_{\pm1.0}$. Hereinafter, explanation is in accordance with the flowchart of FIG. 21.

When the processing is executed, a timer for detecting the actual time $t_{\pm 1.0}$ is started at step S825. Next, at step S826, a determination is made as to whether absolute value of FAFAV has returned to the value within 1.0%. When the absolute value of FAFAV does not return to a value within 1.0%, this processing is repeated until the absolute value returns to such a value. When the absolute value of FAFAV is within 1.0% the program proceeds to step S827, where the value of the timer is stored into RAM 28. Next, at step S828 the timer is reset and the program proceeds to step S817 of FIG. 19B.

At step S817, purge flow quantity correction coefficient KNQPGD at deceleration timing is obtained based on the following equation (13).

$$KNQPGD=1-\eta(t_0/t_{\pm 1.0}) \quad (13)$$

Next, at step S818, purge flow quantity correction coefficient detection flag XQPG is set to "0" and the program proceeds to step S831. At the step S831, deceleration timing correction coefficient detection flag FD, indicating that purge flow quantity correction coefficient KNQPGD at deceleration timing has been detected, is set to "1" and the program proceeds to step S811. At step S811, the purge flow quantity correction coefficient KNQPGD at deceleration timing is stored in RAM 28, and the program proceeds to step S820. There, the learning control prohibition flag FKG is reset to 0 at step S820 and processing ends.

Figure 19B:
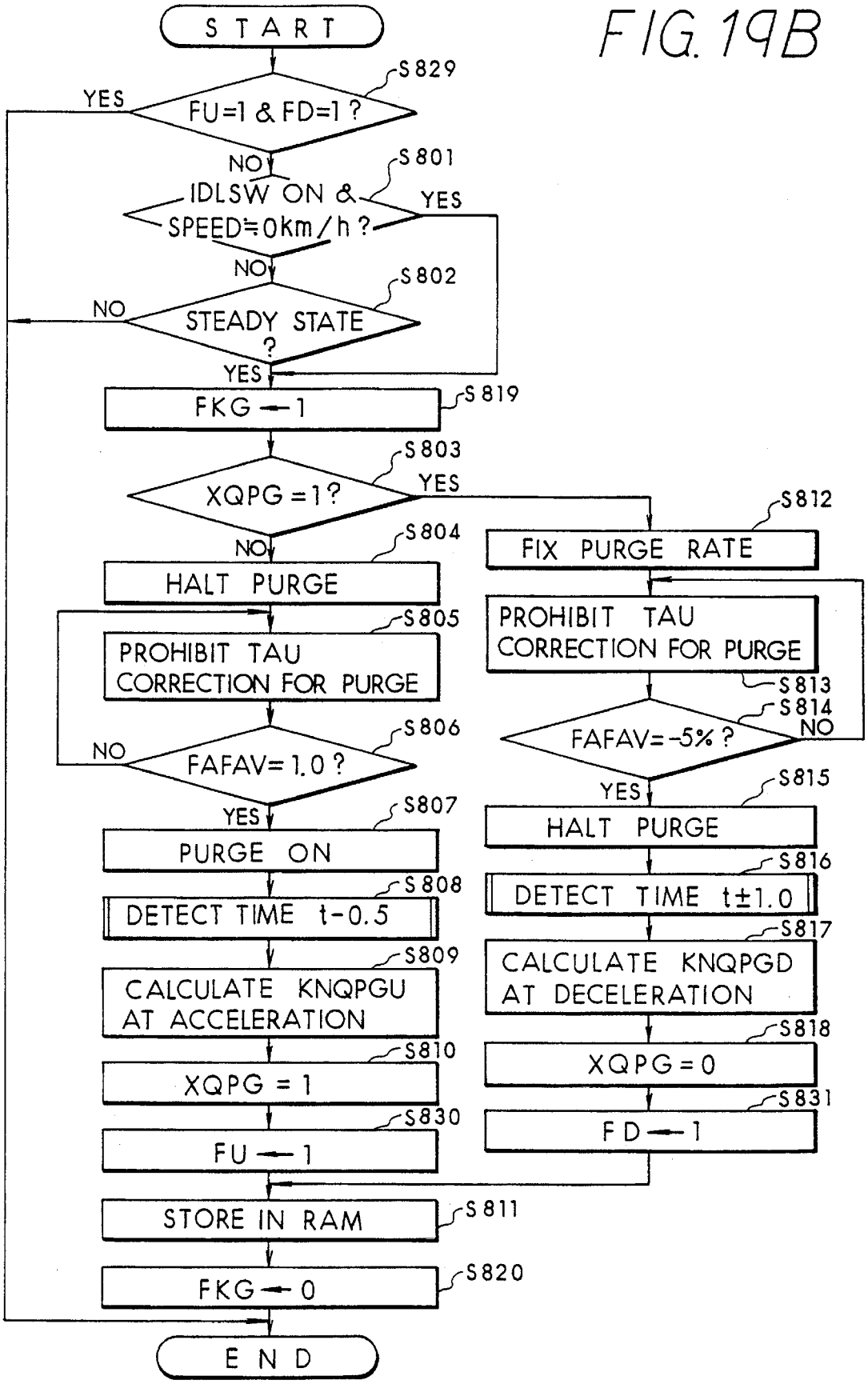

In the above-mentioned detection method, in case purge flow quantity correction coefficient KNQPGU as the second correction coefficient KNQPG2 at deceleration timing is obtained immediately after purge flow quantity correction coefficient KNQPGU at acceleration timing has been obtained, the processing between steps S812 and S814 of FIG. 19B may be omitted because FAFAV has already achieved a value of –0.5%.

Figure 22:
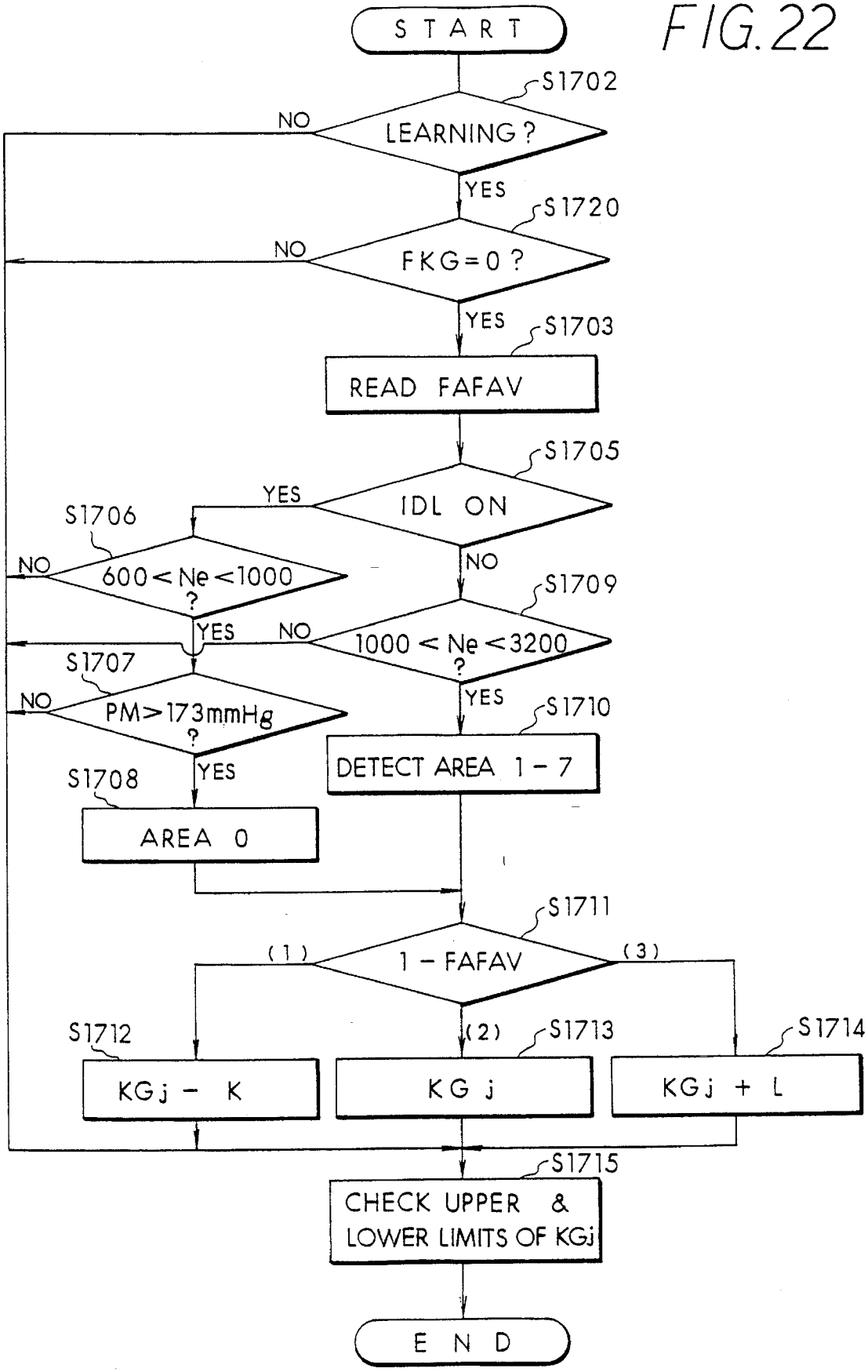
FIG. 22 is a flowchart indicating air-fuel ratio learning control processing to be executed by a CPU of another embodiment.

In addition, while in the above-mentioned detection method the second purge flow quantity correction coefficient is detected, it is necessary to halt air-fuel ratio learning control. Thus, it is necessary to add execution defined by a part of the flowchart of the air-fuel ratio learning control shown in FIG. 18. In other words, when a learning control execution condition is satisfied at step S1702, as shown in FIG. 22, it is determined at step S1720 whether learning control prohibition flag FKG is 0. If FKG is 0, the program proceeds to a step S1703 and using the following processing, the air-fuel ratio learning control is performed. A detailed explanation is omitted here because such has been presented in connection with the description of FIG. 18. When the determination result is NO at step S1703, the program proceeds to step S1715 without execution of the air-fuel ratio learning control. Then, a check regarding the upper and lower limits of the learning value KGj are performed as previously described, and the processing ends.

As described above, with the present invention the fuel injection quantity is corrected, taking into account of delay in the purge flow quantity from the canister. Accordingly, the air-fuel ratio control may be performed accurately.

The present invention has been described in connection with what are currently considered to be the most practical and preferred embodiments of the present invention. However, the present invention is not meant to be limited to the disclosed embodiments, but rather is intended to cover all modifications and alternative arrangements included within the spirit and scope of the appended claims.

What is claimed is:

1. A fuel control apparatus for an internal combustion engine, said fuel control apparatus comprising:

a canister having an absorber for adsorbing fuel evaporation gas generated in a fuel tank for storing fuel therein;

idle control means for controlling an idle speed of said engine;

target purge flow quantity calculating means for calculating a flow quantity of evaporated fuel gas adsorbed by said canister to be purged into an intake conduit based on a predetermined condition;

idle correction means for correcting, in accordance with an actual purge flow quantity, a control quantity of said idle control means;

actual purge flow quantity detecting means which detects, based on a corrected amount from said idle correction means, said actual purge flow quantity actually purged from said canister when purge flow quantity calculated by said target purge flow quantity calculating means is purged; and amount of decline detecting means for detecting an amount of decline in said actual purge flow quantity based on said flow quantity calculated by said target purge flow quantity calculating means and said actual flow quantity detected by said actual purge flow quantity detecting means;

wherein said fuel control means corrects said quantity of fuel to be supplied to said engine based on said amount of decline detected by said amount of decline detecting means.

2. A fuel control apparatus for an internal combustion engine, said apparatus comprising:

a canister having an absorber for adsorbing fuel evaporated gas generated in a fuel tank, said fuel tank being adapted to store fuel therein;

canister pressure detecting means for detecting a canister pressure in said canister;

intake pressure detecting means for detecting an intake pressure in an intake conduit of said internal combustion engine;

decrease quantity detecting means for detecting a decrease quantity of an actual purge flow quantity by comparing a difference between said canister pressure and said intake pressure and a difference between an atmospheric pressure and said intake pressure; and fuel correction means for correcting, in accordance with said decrease quantity, a quantity of fuel to be supplied to said engine.

3. A fuel control apparatus according to claim 2, further comprising:

means for calculating a theoretical value of a purge flow quantity purged from said canister during a predetermined time of at least one of acceleration and deceleration of said engine; and means for detecting a purge flow quantity delay from said theoretical value and a change of canister pressure change during said predetermined time;

wherein said fuel correction means is further for correcting said quantity of fuel in accordance with said purge flow quantity delay.

4. A fuel control apparatus according to claim 2, further comprising:

air-fuel ratio control means for controlling, to a target air-fuel ratio, an air-fuel ratio of air and fuel mixture to be supplied to said engine;

period calculation means for setting a purge flow quantity during engine operating condition of at least one of engine idling and no vehicle speed change so that said target air-fuel ratio is deviated by a predetermined value and calculating a theoretical time period required to deviate said air-fuel ratio by said predetermined value; and purge delay detecting means for detecting an actual time period required to deviate said air-fuel ratio by said predetermined value and calculating a purge delay from said theoretical time period and said actual time period;

wherein said fuel correction means is further for correcting said quantity of fuel in accordance with said purge delay.

5. A fuel control apparatus adapted for use with an internal combustion engine, said apparatus comprising:

a canister provided with an absorber for adsorbing fuel vapor generated in a fuel tank having liquid fuel therein;

canister pressure detection means, mounted on a supply conduit through which said fuel vapor purged from said canister flows, for detecting pressure in a vicinity of said canister;

theoretical purge flow quantity calculation means for calculating a theoretical value of a purge flow quantity that is purged from said canister within a predetermined period including at least one acceleration timing and at least one deceleration timing;

purge flow quantity delay detection means for detection a purge flow quantity delay from said theoretical value of said purge flow quantity and a change in pressures detected by said canister pressure detection means during said predetermined period; and fuel correction means for correcting a quantity of fuel to be supplied to said engine in accordance with said purge flow quantity delay.

6. A fuel control apparatus according to claim 5, further comprising:

purge piping connected to purge said fuel vapor from said canister to an intake conduit of said internal combustion engine;

purge piping condition detecting means for detecting a condition of said purge piping during purging of said fuel vapor;

wherein said fuel correction means corrects said quantity of fuel to be supplied to said engine in accordance with said condition.

7. A fuel control apparatus according to claim 5, further comprising:

means for calculating based on a predetermined condition of said fuel vapor adsorbed by said canister a target purge flow quantity to be purged into an intake conduit of said internal combustion engine; and means for detecting an actual purge flow quantity actually purged from said canister when said target purge flow quantity is purged;

means for detecting decrease of said actual purge flow quantity from said target purge flow quantity;

wherein said fuel correction means corrects said quantity of fuel to be supplied to said engine in accordance with said detected decrease.

8. A fuel control apparatus according to claim 1, further comprising:

idle control means for controlling an idle speed of said engine;

idle correction means for correcting in accordance with said actual purge flow quantity a control quantity of said idle control means; and said means for detecting actual purge flow quantity including means for calculating said actual purge flow quantity in accordance with a correction quantity of said idle correction means.

9. A fuel control apparatus for an internal combustion engine, said apparatus comprising:

a canister for storing fuel vapor generated in a fuel tank;

purge piping for purging said fuel vapor from said canister to an intake conduit of said internal combustion engine;

air-fuel ratio control means for performing feedback control such that an air-fuel ratio of an air-fuel mixture supplied to said internal combustion engine becomes a target air-fuel ratio;

period theoretical value calculation means for setting a purge flow quantity such that said target air-fuel ratio deviates by a predetermined value at an operating condition indicative of at least one state of an idling state and a steady-state travelling state, wherein a vehicle speed is substantially constant, and for calculating a theoretical value of a time period required for deviating by said predetermined value;

purge flow quantity delay detection means for detecting an actual time period required in order that said target air-fuel ratio may actually deviate by said predetermined value, and for detecting delay in said purge flow quantity from said actual time period and said theoretical value; and fuel control means for correcting a quantity of fuel to be supplied to said internal combustion engine in accordance with said delay.

10. A fuel control apparatus according to claim 9, further comprising:

purge piping connected to purge said fuel vapor from said canister to an intake conduit of said internal combustion engine;

purge piping condition detecting means for detecting a condition of said purge piping during purging of said fuel vapor;

wherein said fuel control means corrects said quantity of fuel to be supplied to said engine in accordance with said condition.

11. A fuel control apparatus according to claim 9, further comprising:

means for calculating, based on a predetermined condition of said fuel vapor adsorbed by said canister, a target purge flow quantity to be purged into an intake conduit of said internal combustion engine;

means for detecting an actual purge flow quantity actually purged from said canister when said target purge flow quantity is purged; and means for detecting decrease of said actual purge flow quantity from said target purge flow quantity;

wherein said fuel control means corrects said quantity of fuel to be supplied to said engine in accordance with said detected decrease.

12. A fuel control apparatus according to claim 11, further comprising:

idle control means for controlling an idle speed of said engine;

idle correction means for correcting in accordance with said actual purge flow quantity a control quantity of said idle control means; and said means for detecting actual purge flow quantity including means for calculating said actual purge flow quantity in accordance with a correction quantity of said idle correction means.

* * * * *